US009671087B2

(12) United States Patent
Nakamura

(10) Patent No.: US 9,671,087 B2
(45) Date of Patent: Jun. 6, 2017

(54) ILLUMINATION DEVICE

(71) Applicant: Enplas Corporation, Saitama (JP)

(72) Inventor: Masato Nakamura, Saitama (JP)

(73) Assignee: Enplas Corporation, Saitama (JP)

( * ) Notice: Subject to any disclaimer, the term of this patent is extended or adjusted under 35 U.S.C. 154(b) by 43 days.

(21) Appl. No.: 14/426,779

(22) PCT Filed: Aug. 15, 2013

(86) PCT No.: PCT/JP2013/004871
§ 371 (c)(1),
(2) Date: Mar. 9, 2015

(87) PCT Pub. No.: WO2014/041745
PCT Pub. Date: Mar. 20, 2014

(65) Prior Publication Data

US 2015/0241028 A1 Aug. 27, 2015

(30) Foreign Application Priority Data

Sep. 11, 2012 (JP) ..... 2012-199464

(51) Int. Cl.
*F21V 7/00* (2006.01)
*F21V 13/04* (2006.01)
(Continued)

(52) U.S. Cl.
CPC ..... *F21V 13/04* (2013.01); *F21K 9/232* (2016.08); *F21K 9/60* (2016.08); *F21V 3/02* (2013.01);
(Continued)

(58) Field of Classification Search
CPC . F21K 9/135; F21K 9/50; F21V 13/04; F21V 13/14
See application file for complete search history.

(56) References Cited

U.S. PATENT DOCUMENTS

2006/0083003 A1* 4/2006 Kim ..... F21V 5/04 362/327
2006/0083017 A1* 4/2006 Wang ..... B64F 1/20 362/547
(Continued)

FOREIGN PATENT DOCUMENTS

CN 201739900 U 2/2011
JP 2012-064568 A 3/2012
(Continued)

OTHER PUBLICATIONS

International Search Report for PCT/JP2013/004871 mailed Aug. 15, 2013.

*Primary Examiner* — Andrew Coughlin
*Assistant Examiner* — Alexander Garlen
(74) *Attorney, Agent, or Firm* — Brundidge & Stanger, P.C.

(57) ABSTRACT

In an illumination device, light emitted from an emission element is directed toward a second luminous flux control member by a first luminous flux control member of a luminous flux control member, and then toward the side and rear of the illumination device from the second luminous flux control member. The light is then caused to pass through a cover having a shape in which the ratio (R/O) of the distance (R) between P3-P4 in the Y direction to the distance (O) between P1-P2 in the X direction is greater than 0.33 and less than 1.2, and then the light is evenly distributed to the front, sides and rear of the illumination device.

3 Claims, 55 Drawing Sheets

(51) Int. Cl.

| | |
|---|---|
| ***F21V 3/02*** | (2006.01) |
| ***F21V 13/12*** | (2006.01) |
| ***F21K 9/232*** | (2016.01) |
| ***F21K 9/60*** | (2016.01) |
| *F21V 5/04* | (2006.01) |
| *F21Y 115/10* | (2016.01) |

(52) U.S. Cl.
CPC ..... *F21V 13/12* (2013.01); *F21V 5/045* (2013.01); *F21V 7/0016* (2013.01); *F21Y 2115/10* (2016.08)

(56) References Cited

U.S. PATENT DOCUMENTS

2007/0019416 A1* 1/2007 Han ..... H01L 33/58 362/307
2008/0080192 A1* 4/2008 Ruud ..... F21S 8/083 362/335
2009/0086492 A1* 4/2009 Meyer ..... F21V 3/02 362/294
2011/0051426 A1* 3/2011 Huang ..... F21V 5/04 362/309
2011/0273900 A1* 11/2011 Li ..... F21K 9/135 362/555
2012/0169204 A1* 7/2012 Wu ..... F21K 9/135 313/116
2013/0114254 A1 5/2013 Nakamura
2013/0221829 A1* 8/2013 Kitagawa ..... F21V 3/02 313/110

FOREIGN PATENT DOCUMENTS

JP 2012-074248 A 4/2012
JP 2012-094320 A 5/2012
JP 2012-160666 A 8/2012
JP WO 2012105168 A1 * 8/2012 ..... F21K 9/135
WO 2012005008 A1 1/2012

* cited by examiner

ILLUMINATION DEVICE

TECHNICAL FIELD

The present invention relates to an illumination apparatus having a light emitting element.

BACKGROUND ART

In recent years, in view of energy saving and environmental conservation, illumination apparatuses using light-emitting diodes (hereinafter also referred to as "LED") as light sources, (such as LED bulbs), have been used in place of incandescent lamps. However, the conventional illumination apparatuses using LED as a light source emit light only forward, and cannot emit light in a wide range direction unlike incandescent lamps. Therefore, the conventional illumination apparatuses cannot extensively illuminate a room by using reflected light from the ceiling or the walls unlike incandescent lamps.

To bring the light distribution characteristics of the illumination apparatus using LED as a light source close to those of the incandescent lamps, it is suggested to distribute light emitted from the LED behind the LED with the shape of a cover shading the LED (see, e.g., PTLS 1 and 2).

FIG. 1 is a schematic diagram illustrating the configuration of an illumination apparatus set forth in PTL 1. As illustrated in FIG. 1, LED bulb 101 has LED module 102, base body part 103 on which LED module 102 is mounted, and globe 104 attached to base body part 103. The sectional shape of globe 104 is a domed shape, and the outer diameter D1 of an attachment part to base body part 103 is smaller than the outer diameter D2 of the part having the maximum diameter. Thus, PTL 1 sets forth an example in which backward light distribution is increased by forming globe 104 such that the outer diameter D1 of the attachment part is smaller than the maximum outer diameter D2.

FIG. 2 is a schematic diagram illustrating the configuration of an illumination apparatus set forth in PTL 2. As illustrated in FIG. 2, the illumination apparatus includes at least one light source 105, light source substrate 106 on which light source 105 is mounted, and a cover member 107 shading the periphery of a light emission part of light source 105 and having transparency and light diffusion characteristics. Maximum outer diameter W portion in the direction orthogonal to central axis A of cover member 107 is positioned closer to light source 105 than is center C of cover member 107 in the direction of central axis A. Thus, PTL 2 sets forth an example in which backward light distribution is increased by forming cover member 107 such that maximum outer diameter W portion of cover member 107 is positioned closer to light source 105 than is center C having the dimension of cover member 107 in the direction of central axis A.

CITATION LIST

Patent Literature

PTL 1
Japanese Patent Application Laid-Open No. 2012-64568
PTL 2
Japanese Patent Application Laid-Open No. 2012-74248

SUMMARY OF INVENTION

Technical Problem

In the techniques set forth in the above-listed patent literatures, backward emission light is generated by expanding light emitted from the LED light source having Lambertian light distribution characteristics with a cover (globe). However, light components emitted sideward and backward contained in the light emitted from the LED light source are extremely few. Therefore, it is difficult to achieve sufficient omnidirectional light distribution only with the diffusing capacity of the cover.

A conceivable means to increase the amount of light sideward and backward from the LED illumination apparatus is to control the distribution of light emitted from the LED light source with a light flux controlling member. However, when the amount of light sideward and backward is increased by the light flux controlling member, extreme variation sometimes may occur in the omnidirectional light distribution characteristics. Accordingly, when such a light flux controlling member is used, it is necessary to have further means to allow the distribution of light emitted from the light flux controlling member to have higher uniformity omnidirectionally.

An object of the present invention is to provide an illumination apparatus having a light emitting element and capable of distributing light forward, sideward and backward omnidirectionally in a well-balanced manner.

Solution to Problem

An illumination apparatus of the present invention includes: at least one light emitting element that is disposed on a substrate and has an optical axis along a normal line to the substrate; a light flux controlling member disposed on the substrate to control a distribution of light emitted from the light emitting element; and a cover that covers at least the light emitting element and the light flux controlling member to transmit light emitted from the light flux controlling member while diffusing the emitted light, wherein:

the light flux controlling member includes a first light flux controlling member that is disposed to face the light emitting element, and a second light flux controlling member that is disposed to face the first light flux controlling member;

the first light flux controlling member includes an incidence surface for allowing a part of the light emitted from the light emitting element to enter the incidence surface, a total reflection surface for reflecting a part of the light having entered the incidence surface toward the second light flux controlling member, and an emission surface for emitting a part of the light having entered the incidence surface and the light reflected at the total reflection surface toward the second light flux controlling member;

the second light flux controlling member has a reflection surface that faces the emission surface of the first light flux controlling member to reflect a part of light having been emitted from the first light flux controlling member and having reached the second light flux controlling member, and to transmit a rest of the light;

the reflection surface is a rotationally symmetrical plane about the optical axis as a rotation axis and is formed such that a generatrix line of the rotationally symmetrical plane is a concave curve relative to the first light flux controlling member;

an outer peripheral portion of the reflection surface is disposed at a position distant from the light emitting element in a direction X of the optical axis compared with a center portion of the reflection surface; and R to O (R/O) is more than 0.33 and less than 1.2;

where O represents, in a cross-section including the optical axis, a distance in the direction X from a point, which is the most distant from the substrate, on the light flux controlling member to a point, which is the most distant from the substrate, on an inner surface of the cover, and R represents a distance in a direction Y orthogonal to the optical axis from an intersection of a straight line orthogonal to the optical axis through an outermost edge portion of the total reflection surface and the inner surface of the cover to a point, which is the most distant from the optical axis, of the light flux controlling member.

Advantageous Effects of Invention

The illumination apparatus of the present invention is capable of distributing light omnidirectionally in a well-balanced manner. Accordingly, the illumination apparatus of the present invention is capable of extensively illuminating a room by utilizing light reflected from the ceiling or the walls like an incandescent lamp.

DESCRIPTION OF EMBODIMENTS

Hereinafter, embodiments of the present invention will be described in detail with reference to the accompanying drawings. The following description explains an illumination apparatus which may be used in place of incandescent lamps, as a typical example of the illumination apparatus of the present invention.

[Configuration of Illumination Apparatus]

Figure 1:
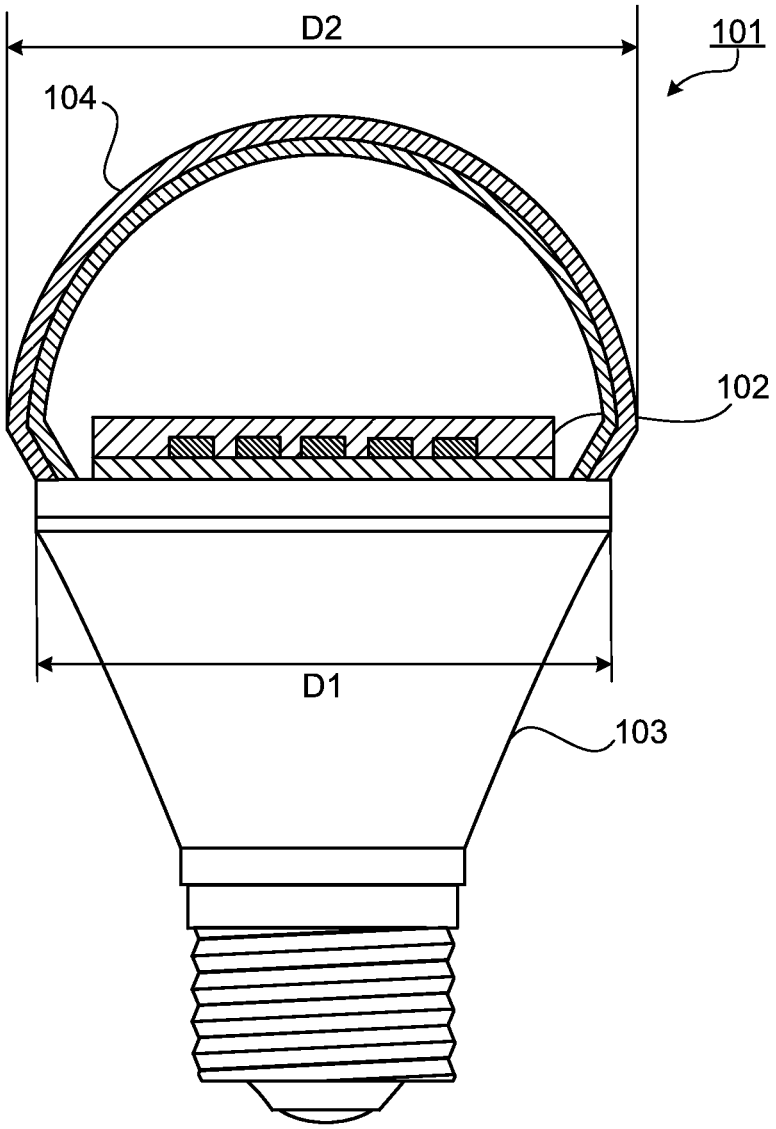
FIG. 1 is a schematic diagram illustrating the configuration of an illumination apparatus set forth in PTL 1.
Figure 2:
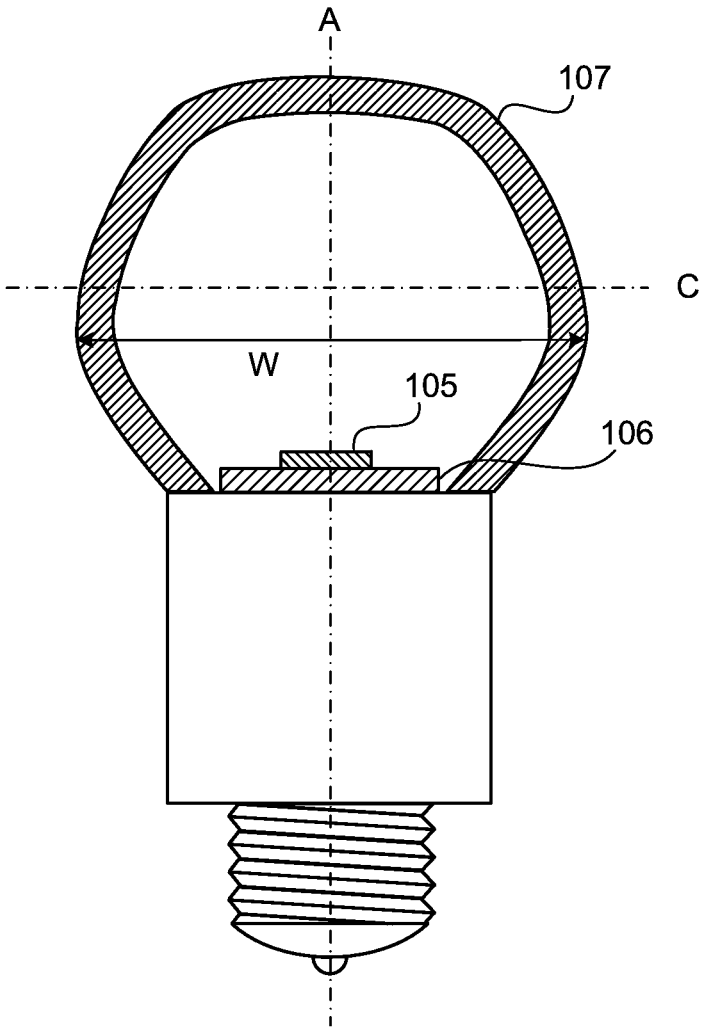
FIG. 2 is a schematic diagram illustrating the configuration of an illumination apparatus set forth in PTL 2.
Figure 3:
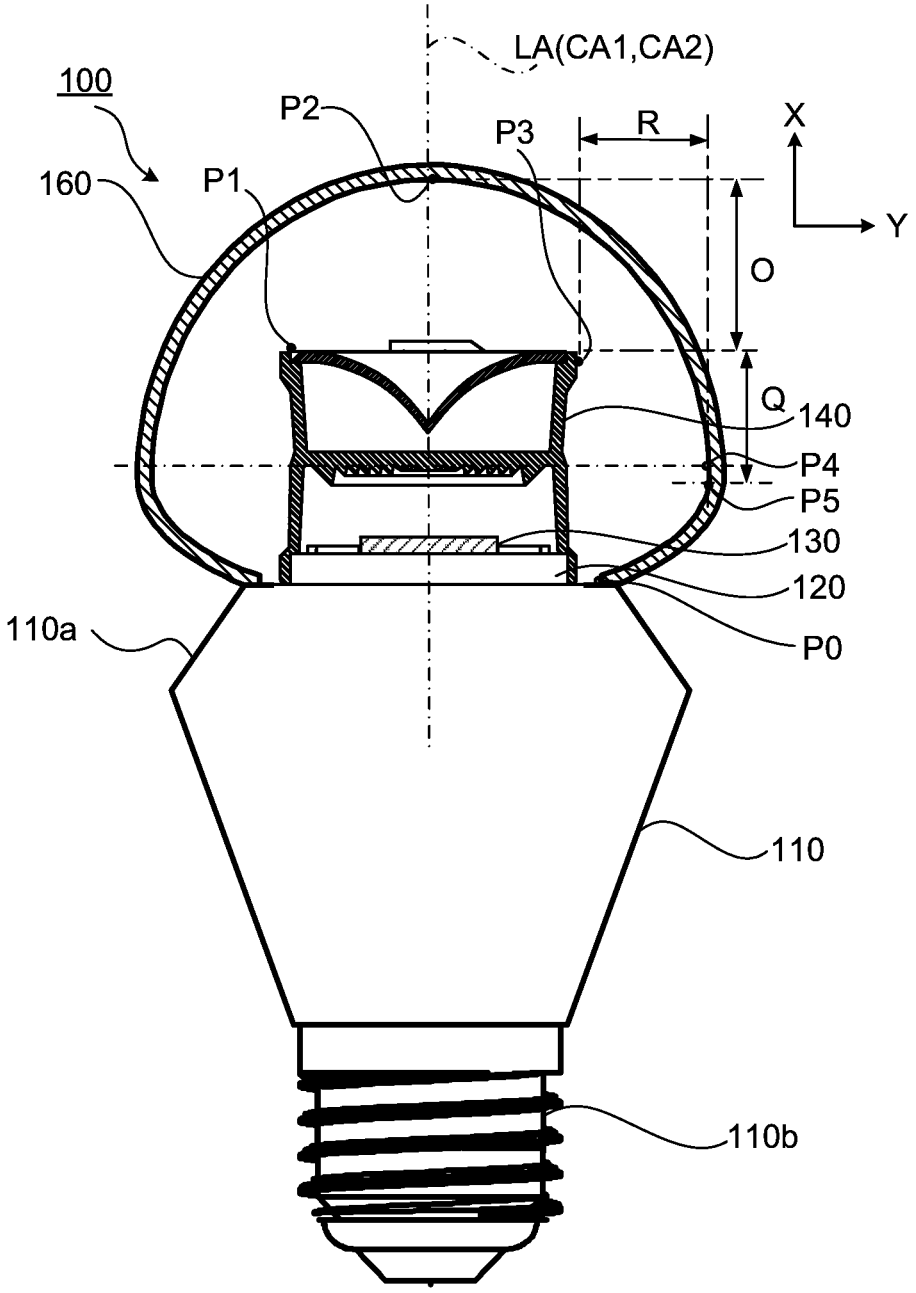
FIG. 3 is a sectional view of a main portion of an illumination apparatus according to an embodiment of the present invention.

FIG. 3 is a sectional view illustrating the configuration of an illumination apparatus according to an embodiment of the present invention. As illustrated in FIG. 3, illumination apparatus 100 includes casing 110, substrate 120, light emitting element 130, light flux controlling member 140 and cover 160. Hereinafter, each component will be described.

(1) Casing, Substrate and Light Emitting Element

Casing 110 has inclining surface 110*a* that inclines from the edge of one end surface of casing 110 toward the other end of casing 110, and a base 110*b* disposed at the other end of casing 110. Casing 110 also serves as a heat sink for releasing heat from light emitting element 130. Inside base 110*b* and the heat sink, a power circuit (not illustrated) electrically connecting base 110*b* and light emitting element 130 is provided. Inclining surface 110*a* is formed so as not to shield light emitted backward through cover 160.

Substrate 120 is disposed on one end surface of casing 110. The shape of substrate 120 is not particularly limited as long as light emitting element 130 can be mounted on substrate 120, and does not need to be a plate-like shape.

Light emitting element 130 is a light source of illumination apparatus 100, and is mounted on substrate 120 fixed on casing 110. Light emitting element 130 is disposed on substrate 120 such that optical axis LA of light emitting element 130 is along the normal line to substrate 120. For example, light emitting element 130 is a light-emitting diode (LED) such as a white light-emitting diode. The term "optical axis of light emitting element" means the traveling direction of light in the center of a three-dimensional light flux from the light emitting element. When there are a plurality of light emitting elements, the term means the traveling direction of light in the center of three-dimensional light fluxes from the plurality of light emitting elements.

(2) Light Flux Controlling Member

Figure 4:
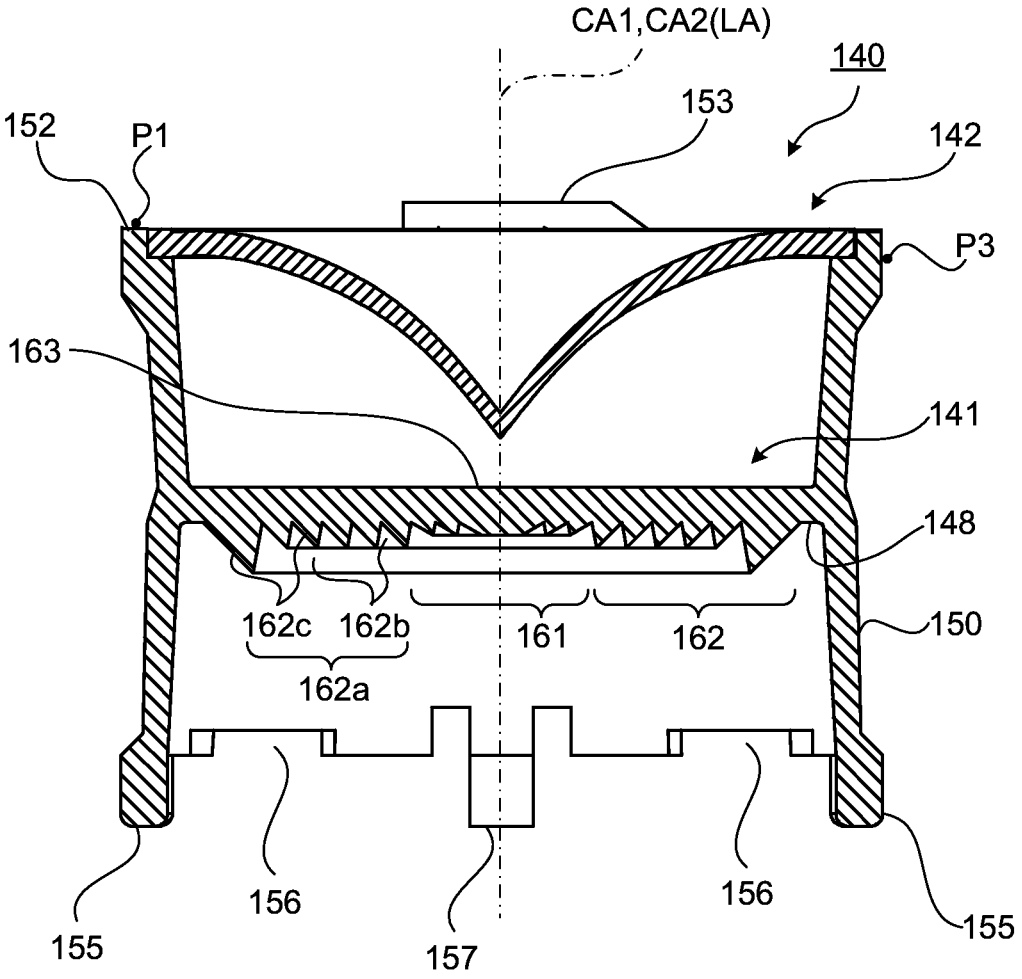
FIG. 4 is a sectional view of a light flux controlling member according to an embodiment of the present invention.

FIG. 4 is sectional view of light flux controlling member 140. Light flux controlling member 140 controls the distribution of light emitted from light emitting element 130. As illustrated in FIG. 4, light flux controlling member 140 includes first light flux controlling member 141 disposed to face light emitting element 130, second light flux controlling member 142 disposed to face first light flux controlling member 141, and holder 150.

(2-1) First Light Flux Controlling Member

Figure 5A:
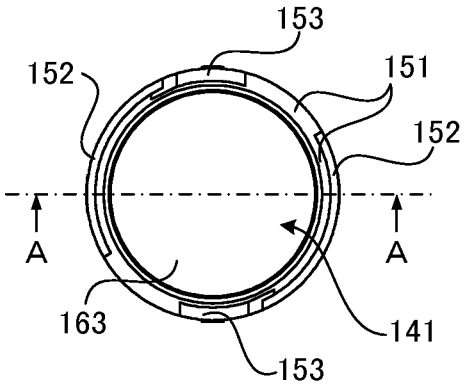
FIG. 5A is a plan view of a first light flux controlling member and a holder according to an embodiment of the present invention.
Figure 5B:
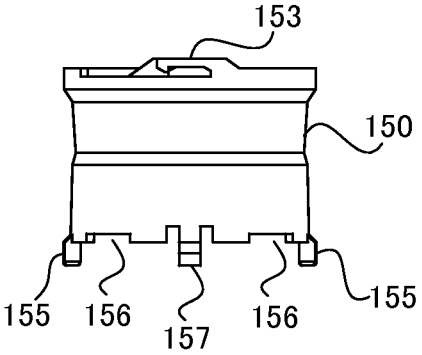
FIG. 5B is a side view of the first light flux controlling member and the holder.
Figure 5D:
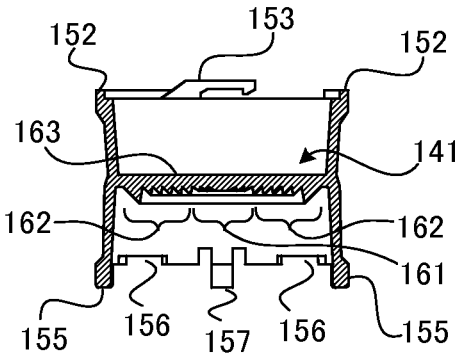
FIG. 5D is a sectional view of the first light flux controlling member and the holder taken along line A-A illustrated in FIG. 5A.
Figure 5C:
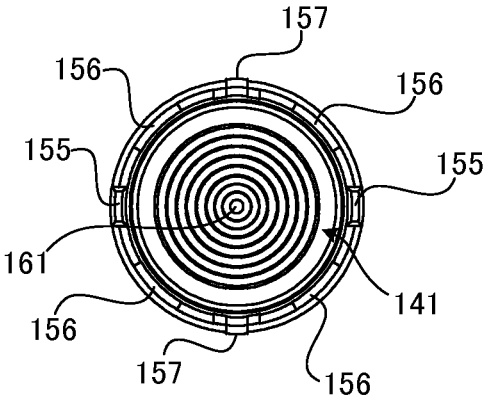
FIG. 5C is a bottom view of the first light flux controlling member and the holder.

FIGS. 5A to 5D are drawings illustrating the configuration of first light flux controlling member 141 and holder 150. FIG. 5A is a plan view of first light flux controlling member 141 and holder 150, FIG. 5B is a side view of first light flux controlling member 141 and holder 150, FIG. 5C is a bottom view of first light flux controlling member 141 and holder 150, and FIG. 5D is a sectional view of first light flux controlling member 141 and holder 150 taken along line A-A illustrated in FIG. 5A.

First light flux controlling member 141 controls the traveling direction of a part of light emitted from light emitting element 130. First light flux controlling member 141 functions such that the distribution of light emitted from first light flux controlling member 141 becomes narrower than the distribution of light emitted from light emitting element 130. As illustrated in FIG. 5A, first light flux controlling member 141 is formed to have a substantially circular shape in a plan view. First light flux controlling member 141 is integrally formed with holder 150, and is disposed with an air layer interposed between light emitting element 130 and first light flux controlling member 141 such that its central axis Ca1 coincides with optical axis LA of light emitting element 130 (see FIG. 4).

As illustrated in FIGS. 4 and 5D, first light flux controlling member 141 has refraction part 161, Fresnel lens part 162, and emission surface 163. When emission surface 163 side is set as the front side of first light flux controlling member 141, refraction part 161 is formed at the center portion on the rear side surface of first light flux controlling member 141. Refraction part 161 allows a part of light emitted from light emitting element 130 to enter refraction part 161 to refract the part of light toward emission surface 163. Thus, refraction part 161 functions as an incidence surface of light entering first light flux controlling member 141.

Fresnel lens part 162 is formed around refraction part 161. Fresnel lens part 162 has a plurality of annular projections 162*a* disposed concentrically. Annular projection 162*a* has inner first inclining surface 162*b* and outer second inclining surface 162*c*. First inclining surface 162*b* allows light emitted from light emitting element 130 to enter first inclining surface 162*b*. Thus, first inclining surface 162*b* functions as an incidence surface of light entering first light flux controlling member 141. Second inclining surface 162*c* totally reflects a part of light having entered first inclining surface 162*b* toward second light flux controlling member 142. Thus, second inclining surface 162*c* functions as a total reflection surface that totally reflects the part of light incident from first inclining surface 162*b*. That is, Fresnel lens part 162 functions as a reflection type Fresnel lens.

First light flux controlling member 141 is formed by injection molding, for example. The material for first light flux controlling member 141 is not particularly limited as long as the material has such higher transparency as to transmit light of a desired wavelength. Examples of the material for first light flux controlling member 141 include optically transparent resins such as polymethylmethacrylate (PMMA), polycarbonate (PC) and epoxy resin (EP), and glass.

Refraction part 161 and first inclining surface 162*b* allow a part of light emitted from light emitting element 130 to enter first light flux controlling member 141. Refraction part 161 has a circular surface in a plan view. Refraction part 161 is, for example, a planar, spherical, aspherical or refractive Fresnel lens. The shape of refraction part 161 is a rotationally symmetrical shape (circular shape) about central axis CA1 as a central axis.

First inclining surface 162*b* is a surface running from the top edge of annular projection 162*a* to the inner bottom edge of annular projection 162*a*, and is a rotationally symmetrical plane about central axis CA1 of first light flux controlling member 141. That is, first inclining surface 162*b* is formed to have an annular shape about central axis CA1 as a central axis. The inclining angles of first inclining surfaces 162*b* may be different from one another, and there may be a case where the first inclining surface 162*b* is parallel to optical axis LA (the inclining angle is 90°). The generatrix line of first inclining surface 162*b* may either be a straight line or a curve. When first inclining surface 162*b* is a curve, the inclining angle of first inclining surface 162*b* is an angle of a tangent of first inclining surface 162*b* relative to central axis CA1.

Second inclining surface 162*c* totally reflects a part of light incident from first inclining surface 162*b* toward second light flux controlling member 142. Second inclining surface 162*c* is a surface running from the top edge of annular projection 162*a* to the outer bottom edge of annular projection 162*a*. Flange 148 is provided between the outer edge of outermost second inclining surface 162*c* and the outer edge of emission surface 163. Flange 148 may not be provided.

Second inclining surface 162*c* is a rotationally symmetrical plane formed to surround central axis CA1 of first light flux controlling member 141. The diameter of second inclining surface 162*c* is gradually increased toward the bottom edge from the top edge of annular projection 162*a*. The generatrix line forming second inclining surface 162*c* is an arc-shaped curve protruding toward the outside (side away from central axis CA1). Further, depending on light distribution characteristics required for illumination apparatus 100, the generatrix line forming second inclining surface 162*c* may be a straight line. That is, second inclining surface 162*c* may have a tapered shape.

It is noted that the term "generatrix line" generally means a straight line to draw a ruled surface, but in the present invention, is used as a term including a curve to draw second inclining surface 162*c* that is a rotationally symmetrical plane. The inclining angle of second inclining surfaces 162*c* may vary for each individual second inclining surface 162*c*. When second inclining surface 162*c* is a curved surface, the inclining angle of second inclining surface 162*c* is an angle of a tangent of second inclining surface 162*c* relative to central axis CA1.

Emission surface 163 emits a part of light emitted from refraction part 161 and first inclining surface 162*b* and light totally reflected at second inclining surface 162*c* toward second light flux controlling member 142. Emission surface 163 is a surface positioned, opposite to Fresnel lens part 162 formed on the rear side of, (on the front side of) first light flux controlling member 141. That is, emission surface 163 is disposed to face second light flux controlling member 142.

(2-2) Second Light Flux Controlling Member

Figure 6A:
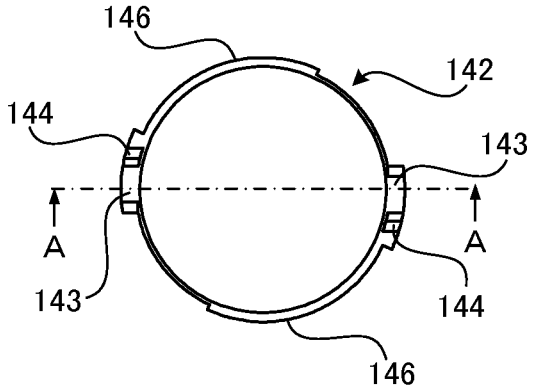
FIG. 6A is a plan view of a second light flux controlling member according to an embodiment of the present invention.
Figure 6B:
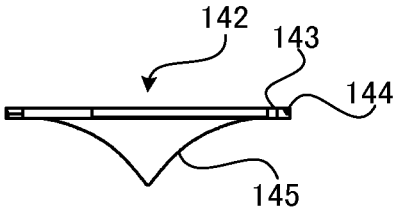
FIG. 6B is a side view of the second light flux controlling member.
Figure 6D:
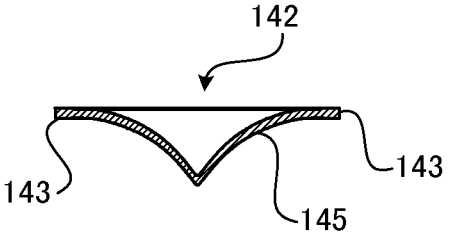
FIG. 6D is a sectional view of the second light flux controlling member taken along line A-A illustrated in FIG. 6A.
Figure 6C:
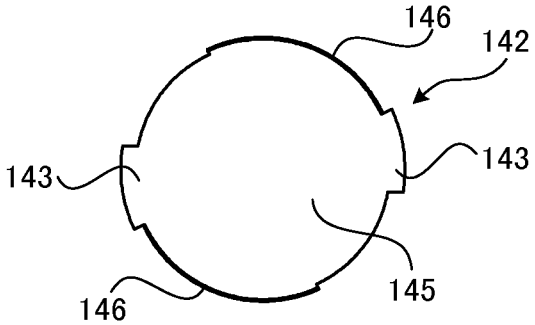
FIG. 6C is a bottom view of the second light flux controlling member.

FIGS. 6A to 6D are drawings illustrating the configuration of second light flux controlling member 142. FIG. 6A is a plan view of second light flux controlling member 142, FIG. 6B is a side view of second light flux controlling member 142, FIG. 6C is a bottom view of second light flux controlling member 142, and FIG. 6D is a sectional view of second light flux controlling member 142 taken along line A-A illustrated in FIG. 6A.

Second light flux controlling member 142 controls the traveling direction of a part of light, having been emitted from first light flux controlling member 141 and having reached second light flux controlling member 142, to reflect a part of the light while transmitting the rest of the light. As illustrated in FIG. 6A, second light flux controlling member 142 is a member formed to have a substantially circular shape in a plan view. Second light flux controlling member 142 is supported by holder 150, and is disposed with an air layer interposed between first light flux controlling member 141 and second light flux controlling member 142 such that its central axis Ca2 coincides with optical axis LA of light emitting element 130.

The means for imparting the functions of the partial reflection and partial transmission described above to second light flux controlling member 142 is not particularly limited. For example, a transmissive/reflective film may be formed on the surface of second light flux controlling member 142 (surface facing light emitting element 130 and first light flux controlling member 141) made of an optically transparent material. Examples of the optically transparent material include transparent resin materials such as polymethylmethacrylate (PMMA), polycarbonate (PC) and epoxy resin (EP), and glass. Examples of the transmissive/reflective film include dielectric multilayer films such as a multilayer film of $TiO_2$ and $SiO_2$, a multilayer film of $ZnO_2$ and $SiO_2$ and a multilayer film of $Ta_2O_5$ and $SiO_2$, and a metallic thin film made of aluminum (Al).

Further, light-scattering elements such as beads may be dispersed inside second light flux controlling member 142 made of an optically transparent material. That is, second light flux controlling member 142 may be formed of a material that reflects a part of the light and transmits a part of the light.

Further, an optically transparent part may be formed in second light flux controlling member 142 made of an optically reflective material. Examples of the optically reflective material include white resins and metals. Examples of the optically transparent part include a through-hole and a bottomed recess. In the latter case, light emitted from light emitting element 130 and first light flux controlling member 141 is transmitted through the bottom portion (thin portion) of the recess. For example, it is possible to form second light flux controlling member 142 having both optically reflective and optically transparent functions with a light transmittance of visible light of about 20% and a light reflectance of about 78% by using white polymethylmethacrylate.

It is preferable that a surface, which faces first light flux controlling member 141, of second light flux controlling member 142 (reflection surface 145 to be described hereinafter) is formed such that reflection intensity of incident light in a specular reflection direction is greater than reflection intensity in other directions. Therefore, the surface, which faces first light flux controlling member 141, of second light flux controlling member 142 is formed to have a glossy surface.

Second light flux controlling member 142 has reflection surface 145 that faces first light flux controlling member 141 to reflect a part of the light emitted from first light flux controlling member 141. Reflection surface 145 reflects a part of light emitted from first light flux controlling member 141 toward holder 150. The reflected light is transmitted through holder 150 to reach the middle portion (side portion) and the lower portion of cover 160.

Reflection surface 145 of second light flux controlling member 142 is a rotationally symmetrical (circularly symmetrical) plane about central axis CA2 of second light flux controlling member 142. Further, as illustrated in FIG. 4, the generatrix line from the center of this rotationally symmetrical plane to the outer peripheral portion is a concave curve relative to light emitting element 130 and first light flux controlling member 141, and reflection surface 145 is a curved surface formed by rotating the generatrix line by 360°. That is, reflection surface 145 has an aspherical curved surface of which height from light emitting element 130 is increased toward the outer peripheral portion away from the center.

Further, the outer peripheral portion of reflection surface 145 is formed at a position distant (in height) from light emitting element 130 in the direction of optical axis LA of light emitting element 130 compared with the center of reflection surface 145. For example, reflection surface 145 is an aspherical curved surface of which height from light emitting element 130 is increased toward the outer peripheral portion away from the center, or is an aspherical curved surface of which height from light emitting element 130 (substrate 120) is increased toward the outer peripheral portion away from the center portion between the center portion and a predetermined point, and the height from light emitting element 130 is decreased toward the outer peripheral portion away from the center portion between the predetermined point and the outer peripheral portion.

In the former case, the inclining angle of reflection surface 145 relative to the plane direction of substrate 120 becomes smaller toward the outer peripheral portion away from the center. In the latter case, reflection surface 145 has a point at which the inclining angle relative to the plane direction of substrate 120 is zero (parallel to substrate 120) near the outer peripheral portion between the center and the outer peripheral portion. It is noted that, as described above, the term "generatrix line" generally means a straight line to draw a ruled surface, but in the present invention, is used as a term including a curve to draw reflection surface 145 that is a rotationally symmetrical plane.

(3) Holder

Holder 150 is positioned at substrate 120, and at the same time positions first light flux controlling member 141 and second light flux controlling member 142 with respect to light emitting element 130.

Holder 150 is an optically transparent member formed to have a substantially cylindrical shape. Second light flux controlling member 142 is fixed to one end portion of holder 150. The other end portion of holder 150 is fixed to substrate 120. In the following description, the end portion to which second light flux controlling member 142 is fixed is referred to as "upper end portion," and the end portion which is fixed to substrate 120 is referred to as "lower end portion," out of the two end portions of holder 150.

Holder 150 is formed by integral molding together with first light flux controlling member 141. The material for holder 150 is not particularly limited as long as the material can transmit light of a desired wavelength. Examples of the material for holder 150 include optically transparent resins such as polymethylmethacrylate (PMMA), polycarbonate (PC) and epoxy resin (EP), and glass. When a light diffusion capacity is imparted to holder 150, a scattering element may be added in these optically transparent materials, or the surface of holder 150 may be subjected to light diffusion treatment.

As illustrated in FIGS. 5A to 5D, on the upper end portion of holder 150, guide projection 152 and claw part 153 are provided for fixing second light flux controlling member 142 on end surface 151 of the upper end portion.

Guide projection 152 is formed at a part of the outer peripheral portion of end surface 151 of the upper end portion to prevent second light flux controlling member 142 from moving in the radial direction of holder 150. The number of guide projection 152 is not particularly limited, but is usually two or more. In the example illustrated in FIGS. 5A to 5D, holder 150 has two guide projections 152 facing each other. Further, the shape of guide projection 152 is not particularly limited as long as guide projection 152 can be fitted into second light flux controlling member 142 diametrically. In the example illustrated in FIGS. 5A to 5D, the shape of guide projection 152 in a plan view is an arc shape.

Claw part 153 is formed on end surface 151 of the upper end portion. As described later, claw part 153 is fitted into fitting part 143 (recess 144) of second light flux controlling member 142 to prevent second light flux controlling member 142 from being disengaged and from rotating. The number of claw part 153 is not particularly limited, but is usually two or more. In the example illustrated in FIGS. 5A to 5D, holder 150 has two claw parts 153 facing each other. Further, the shape of claw part 153 is not particularly limited as long as claw part 153 can be fitted into recess 144 of second light flux controlling member 142 when second light flux controlling member 142 is rotated.

End surface 151 for mounting thereon second light flux controlling member 142 is formed around the entire circumference of the upper end portion of holder 150. That is, end surface 151 also exists inside guide projection 152 and inside claw part 153 (see FIG. 5A). Accordingly, when light flux controlling member 140 is viewed in a plan view, the outer peripheral portion (flange 146) of second light flux controlling member 142 overlaps end surface 151 of the upper end portion around the entire circumference. Therefore, light is prevented from leaking through a gap between second light flux controlling member 142 and holder 150.

Boss 155 for positioning holder 150 on casing 110 and locking claw 157 for locking into a locking hole (not illustrated) formed on one end surface of casing 110 or substrate 120 are provided at the lower end portion of holder 150. Further, ventilation port 156 for ventilating the air around first light flux controlling member 141 is also provided.

The method for manufacturing light flux controlling member 140 is not particularly limited. For example, light flux controlling member 140 may be manufactured by assembling second light flux controlling member 142 to an integrally molded product of first light flux controlling member 141 and holder 150. When second light flux controlling member 142 is assembled, an adhesive or the like may be used. The integrally molded product of first light flux controlling member 141 and holder 150 may be produced by injection molding using a colorless transparent resin material, for example.

Second light flux controlling member 142 may be produced, for example, by vapor deposition of a transmissive/reflective film on a surface to be reflection surface 145 after injection molding using a colorless transparent resin material, or by injection molding using a white resin material. Second light flux controlling member 142 is assembled to the integrally molded product of first light flux controlling member 141 and holder 150 by fitting claw part 153 of holder 150 into recess 144 of second light flux controlling member 142 and rotating second light flux controlling member 142.

It is noted that first light flux controlling member 141 and holder 150 may be molded separately. In this case, first light flux controlling member 141 is assembled to holder 150, and second light flux controlling member 142 is assembled to holder 150, thereby enabling light flux controlling member 140 to be manufactured. Separate molding of first light flux controlling member 141 and holder 150 enhances the freedom in selecting the material for forming holder 150 and first light flux controlling member 141. For example, it becomes easier to form holder 150 with an optically transparent material containing a scattering element, and to form first light flux controlling member 141 with an optically transparent material free from a scattering element.

Next, the optical path of light emitted from light emitting element 130 in light flux controlling member 140 will be described.

Light with a large angle relative to optical axis LA of light emitting element 130 enters first light flux controlling member 141 through first inclining surface 162*b*. The light having entered first light flux controlling member 141 is reflected at second inclining surface 162*c* toward second light flux controlling member 142, and is emitted from emission surface 163. Then, a part of the light having reached second light flux controlling member 142 is transmitted through second light flux controlling member 142 and reaches the upper portion of cover 160.

Further, a part of the light having reached second light flux controlling member 142 is reflected at reflection surface 145 of second light flux controlling member 142, and reaches the middle portion (side portion) and the lower portion of cover 160 through holder 150. At that time, the light reflected at the center portion of second light flux controlling member 142 is propagated toward the middle portion of cover 160. The light reflected at the outer peripheral portion of second light flux controlling member 142 is propagated toward the lower portion of cover 160.

Light with a small angle relative to optical axis LA of light emitting element 130 enters first light flux controlling member 141 through refraction part 161, and is emitted through emission surface 163 to reach second light flux controlling member 142. Then, on one hand, a part of the light having reached second light flux controlling member 142 is transmitted through second light flux controlling member 142, and reaches the upper portion of cover 160.

On the other hand, a part of the light having reached second light flux controlling member 142 is reflected at reflection surface 145 of second light flux controlling member 142, and reaches the middle portion and the lower portion of cover 160 through holder 150. At that time, the light reflected at the center portion of second light flux controlling member 142 is propagated toward the middle portion of cover 160. Further, the light reflected at the outer peripheral portion of second light flux controlling member 142 is propagated toward the lower portion of cover 160. Thus, the light emitted from light emitting element 130 is distributed forward, sideward and backward (see FIG. 9).

(4) Cover

Cover 160 diffuses light of which traveling direction was controlled (reflected light and transmitted light) by light flux controlling member 140 while transmitting the light. Cover 160 is a member which has an opening and in which a hollow area is formed. Substrate 120, light emitting element 130 and light flux controlling member 140 are disposed inside the hollow area of cover 160.

The means for imparting a light diffusion capacity to cover 160 is not particularly limited. For example, the inner surface or outer surface of cover 160 may be subjected to light diffusion treatment (e.g., roughening), or cover 160 may be produced using a light diffusive material (e.g., an optically transparent material containing a scattering element such as beads).

Cover 160 is formed such that, when a point on the opening of cover 160 in the direction Y is set as P0 and a point being the maximum diameter from optical axis LA in the direction Y is set as P5, the internal diameter of cover 160 is gradually increased toward P5 away from P0. The shape of cover 160 further satisfies the following Expression (1). The shape of cover 160 may be, for example, a spherical crown shape (such a shape that a part of spherical surface is truncated with a plane), but is not particularly limited as long as the shape of cover 160 is within such a range as to further satisfy the following Expression (1):

$$0.33<R/O<1.2 \quad (1)$$

In the above-mentioned Expression, "O" means a distance in the direction X along optical axis LA from a point, which is the most distant from substrate 120, on light flux controlling member 140 to a point, which is the most distant from substrate 120, on the inner surface of cover 160 (see FIG. 3). The phrase "in the direction X . . . a point, which is the most distant from substrate, on light flux controlling member" means a point at the most distant position from the substrate in the direction X, among portions having a function of controlling the distribution of emitted light of light flux controlling member 140. For example, the point indicates a point on guide projection 152 or a point on the outer peripheral portion of second light flux controlling member 142 (P1 in FIG. 4). The phrase "in the direction X . . . a point, which is the most distant from substrate, on the inner surface of cover" means, for example, an intersection between the inner surface of cover 160 and optical axis LA (P2 in FIG. 3). The term "distance in the direction X" between these points means, for example, the difference between the distance from P2 to the surface of substrate 120 and the distance from P1 to the surface of substrate 120.

In the above-mentioned Expression, "R" means a distance in the direction Y orthogonal to optical axis LA from a point, which is the most distant from optical axis LA, of light flux controlling member 140 to an intersection of a straight line orthogonal to optical axis LA through the outermost edge portion of the total reflection surface and the inner surface of the cover, in the cross-section including optical axis LA (see FIG. 3). The phrase "in the direction Y . . . a point, which is the most distant from optical axis, of light flux controlling member" means a point at the most distant position from the optical axis in the direction Y, among portions having a function of controlling the distribution of emitted light of light flux controlling member 140. For example, the point is indicated as a point on the side surface of the upper end portion of holder 150 (P3 in FIG. 4). The term "intersection of a straight line orthogonal to optical axis LA through the outermost edge portion of the total reflection surface and the inner surface of the cover" means, for example, an intersection of a straight line orthogonal to optical axis LA through the outermost edge portion of the total reflection surface (bottom edge of second inclining surface 162*c* positioned at the outermost edge of Fresnel lens part 162) of light flux controlling member 140 and the inner surface at the portion of cover 160, in the cross-section including optical axis LA (P4 in FIG. 3). The term "distance in the direction Y" between these points means, for example, the difference between the distance from P4 to optical axis LA and the distance from P3 to optical axis LA. The surface running through the outermost edge portion of the total reflection surface of light flux controlling member 140 can also be paraphrased as a reference surface for forming second inclining surface 162*c* as the total reflection surface.

When R/O is 0.33 or less, among the light emitted from light flux controlling member 140, light having an angle of 0° or more and 30° or less relative to optical axis LA, with a luminescence center of light emitting element 130 as a reference, enters cover 160 at a larger angle, causing this light not to be emitted easily through cover 160. Therefore, among the light emitted through cover 160, the amount of light having an angle of 0° or more and 30° or less relative to optical axis LA undesirably becomes smaller.

When R/O is 1.2 or more, among the light emitted through cover 160, the amount of light having an angle of 0° or more and 30° or less relative to optical axis LA, with the luminescence center of light emitting element 130 as a reference, becomes larger, while the amount of light having an angle of more than 90° and 120° or less becomes relatively smaller. Therefore, the distribution of light emitted through cover 160 may become narrower.

It is noted that the front surface or rear surface of cover 160 may either be a smooth surface or a roughened surface. By forming the front surface or rear surface of cover 160 to be roughened, it becomes possible to reduce illuminance unevenness of illumination apparatus 100.

From the viewpoint of enabling an appropriate omnidirectional light distribution as an illumination apparatus, illumination apparatus 100 preferably satisfies the relationships of the following Expressions (2) and (3):

$$0.8<Ea/E\max\leq 1 \quad (2)$$

$$0.6<Ed/E\max\leq 1 \quad (3)$$

In the above-mentioned Expression, Ea means the sum of relative illuminance of light emitted to an area with an angle of 0° or more and 30° or less relative to optical axis LA, with the luminescence center of light emitting element 130 as a reference, among the light emitted through cover 160, and Ed means the sum of relative illuminance of light emitted to an area with an angle of more than 90° and 120° or less. In addition, Emax means the maximum value of Ea to Ee, when the sum of relative illuminance of light emitted to an area with an angle of more than 30° and 60° or less relative to optical axis LA, with the luminescence center of light emitting element 130 as a reference, among the light emitted through cover 160, is set as Eb, the sum of relative illuminance of light emitted to an area with an angle of more than 60° and 90° or less is set as Ec, and the sum of relative illuminance of light emitted to an area with an angle of more than 120° and 150° or less is set as Ee. The term "relative illuminance" means illuminance at a position having an equal distance from the luminescence center of the light emitting element. The relative illuminance may either be a measured value, or a calculated value of illuminance on a virtual plane.

In the above-mentioned Expression (2), when Ea=Emax, Ea/Emax is 1, the maximum value. When Ea/Emax is 0.8 or less, the amount of light having an angle of 0° or more and 30° or less relative to optical axis LA becomes smaller, among the light emitted through cover 160. Therefore, the distribution of light emitted through cover 160 is such that it becomes unfavorably darker around the angle of 0°.

In the above-mentioned Expression (3), when Ed=Emax, Ed/Emax is 1, the maximum value. When Ed/Emax is 0.6 or less, the amount of light having an angle of more than 90° and 120° or less relative to optical axis LA becomes smaller, among the light emitted through cover 160. Therefore, the light emitted through cover 160 does not sufficiently reach behind the illumination apparatus (the other end side of casing 110). Thus, optimum omnidirectional light distribution may not be obtained from the illumination apparatus.

Ea/Emax and Ed/Emax may be adjusted by the above-mentioned R/O and the distance in the direction Y orthogonal to optical axis LA from the surface of substrate 120 to point P5 being the maximum diameter on the inner surface of cover 160 (see FIG. 3). For example, when P5 is closer to substrate 120 than P1 is to substrate 120 in the direction of optical axis LA, the amount of light forward tends to be increased, while the amount of light sideward and backward tends to be decreased. When P5 is at a more distant position from substrate 120 than P1 is from substrate 120 in the direction of optical axis LA, the amount of light sideward and backward tends to be increased, while the amount of light forward tends to be decreased.

Effect

In illumination apparatus 100, the amount of light reaching second light flux controlling member 142 is increased by reflecting the light, emitted from light emitting element 130, having a larger angle relative to optical axis LA of light emitting element 130 at second inclining surface 162*c* of first light flux controlling member 141. In addition, the amount of emitted light sideward and backward is increased by reflecting a part of the light having reached second light flux controlling member 142 toward the middle portion and the lower portion of cover 160. Further, the amount of emitted light in each direction of forward, sideward and backward directions through cover 160 is made to be equal by transmitting the light emitted from light flux controlling member 140 through cover 160 having such a shape as to satisfy the above-mentioned Expression (1). Therefore, illumination apparatus 100 makes it possible to achieve the light distribution characteristics closer to those of an incandescent lamp. Illumination apparatus 100 may be used for interior illumination or the like in place of an incandescent lamp. In addition, illumination apparatus 100 can save the power consumption as compared with incandescent lamps and can be used for a longer period of time than incandescent lamps.

[Modification of Light Flux Controlling Member]

Figure 7A:
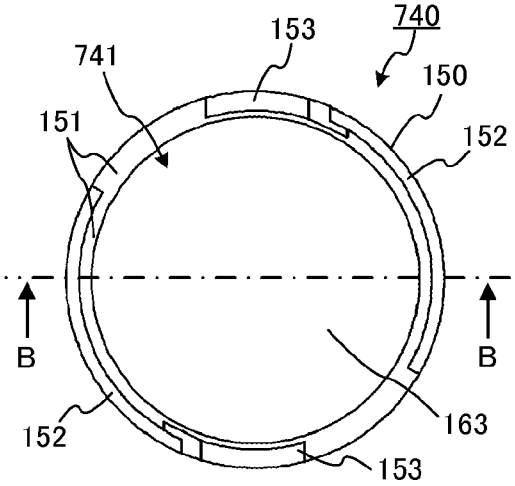
FIG. 7A is a plan view of a first light flux controlling member and a holder according to another embodiment of the present invention.
Figure 7B:
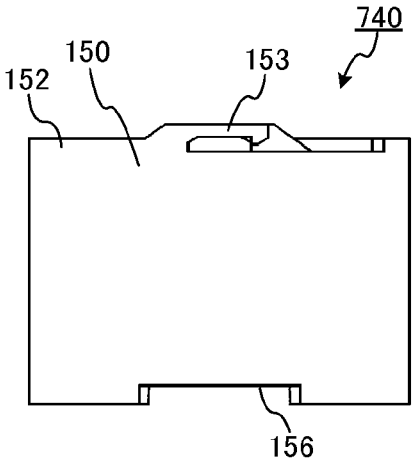
FIG. 7B is a side view of the first light flux controlling member and the holder.
Figure 7C:
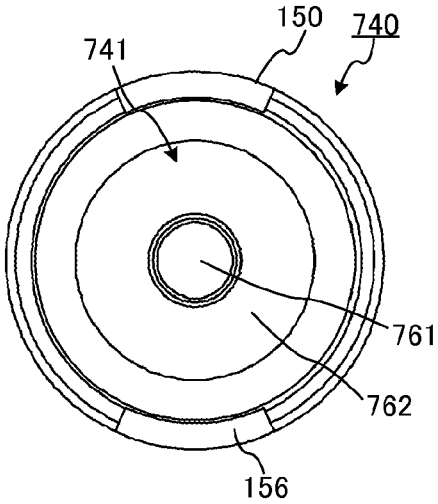
FIG. 7C is a bottom view of the first light flux controlling member and the holder.
Figure 7D:
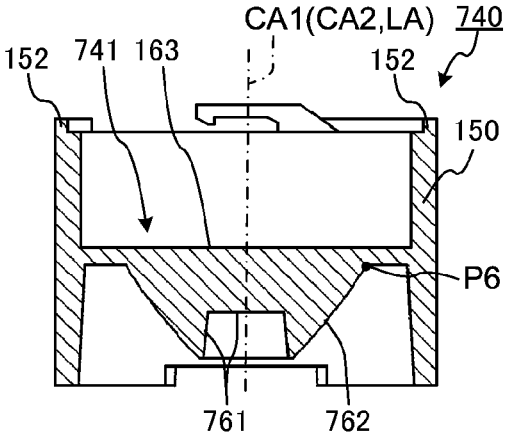
FIG. 7D is a sectional view of the first light flux controlling member and the holder taken along line B-B illustrated in FIG. 7A.

As illustrated in FIGS. 7A, 7B, 7C and 7D, light flux controlling member 740 not including Fresnel lens part 162 can be used in place of light flux controlling member 140. FIGS. 7A, 7B, 7C and 7D are drawings illustrating the configuration of a first light flux controlling member and a holder according to another embodiment of the present invention. FIG. 7A is a plan view of first light flux controlling member 741 and holder 150, FIG. 7B is a side view of first light flux controlling member 741 and holder 150, FIG. 7C is a bottom view of first light flux controlling member 741 and holder 150, and FIG. 7D is a sectional view of first light flux controlling member 741 and holder 150 taken along line B-B illustrated in FIG. 7A. The same components as those of first light flux controlling member 141 and holder 150 illustrated in FIG. 4 are indicated by the same reference signs, and the explanations therefor will be omitted.

Light flux controlling member 740 has first light flux controlling member 741 and holder 150 in addition to second light flux controlling member 142 (not illustrated). First light flux controlling member 741 has incidence surface 761 that allows light emitted from light emitting element 130 to enter incidence surface 761, total reflection surface 762 that totally reflects a part of the light incident through incidence surface 761, and emission surface 163 that emits a part of the light incident through incidence surface 761 and the light reflected at total reflection surface 762.

Incidence surface 761 is the inner surface of a recess formed at the bottom portion of first light flux controlling member 741. Incidence surface 761 has an inner top surface forming the top surface of the recess, and a tapered inner side surface forming the side surface of the recess. The inner side surface has an inner diameter gradually increasing toward the opening edge side away from the inner top surface side such that the inner diameter dimension of the opening edge side is larger than the inner diameter dimension of the inner top surface side (see FIG. 7D).

Total reflection surface 762 is a surface extending from the outer edge of the bottom portion of first light flux controlling member 741 to the outer edge of emission surface 163. Total reflection surface 762 is a rotationally symmetrical plane formed to surround central axis CA1 of first light flux controlling member 741. The diameter of total reflection surface 762 is gradually increased toward emission surface 163 away from the bottom portion side. The generatrix line forming total reflection surface 762 is an arc-shaped curve protruding toward the outside (side away from central axis CA1). The generatrix line forming total reflection surface 762 may be a straight line, and total reflection surface 762 may have a tapered shape.

The "R" in the present modification can also be defined in the same manner as in the illumination apparatus having light flux controlling member 140. That is, the "R" in the present modification is a distance in the direction Y orthogonal to optical axis LA from an intersection of a straight line orthogonal to the optical axis through the outermost edge portion of total reflection surface 762 and the inner surface of the cover to a point, which is the most distant from optical axis LA, of light flux controlling member 740, in the cross-section including optical axis LA.

The outermost edge portion of total reflection surface 762 means the upper end edge of total reflection surface 762, and, for example, is indicated by point P6 in FIG. 7D. The surface running through the outermost edge portion of total reflection surface 762 of light flux controlling member 740 can also be paraphrased as a reference surface for forming total reflection surface 762. Illumination apparatus 100 makes it possible to achieve the light distribution characteristics closer to those of the incandescent lamp also by using such light flux controlling member 740.

EXAMPLES

The light distribution characteristics of illumination apparatuses with differently shaped covers were determined by simulation. Specifically, the omnidirectional relative illuminance of a plane including optical axis LA is determined, with the luminescence center of light emitting element 130 as a reference point. In the simulation, the illuminance on a virtual plane at a distance of 1,000 mm from the luminescence center of light emitting element 130 was calculated.

(Light Distribution Characteristics of Light Flux Controlling Member)

Figure 8:
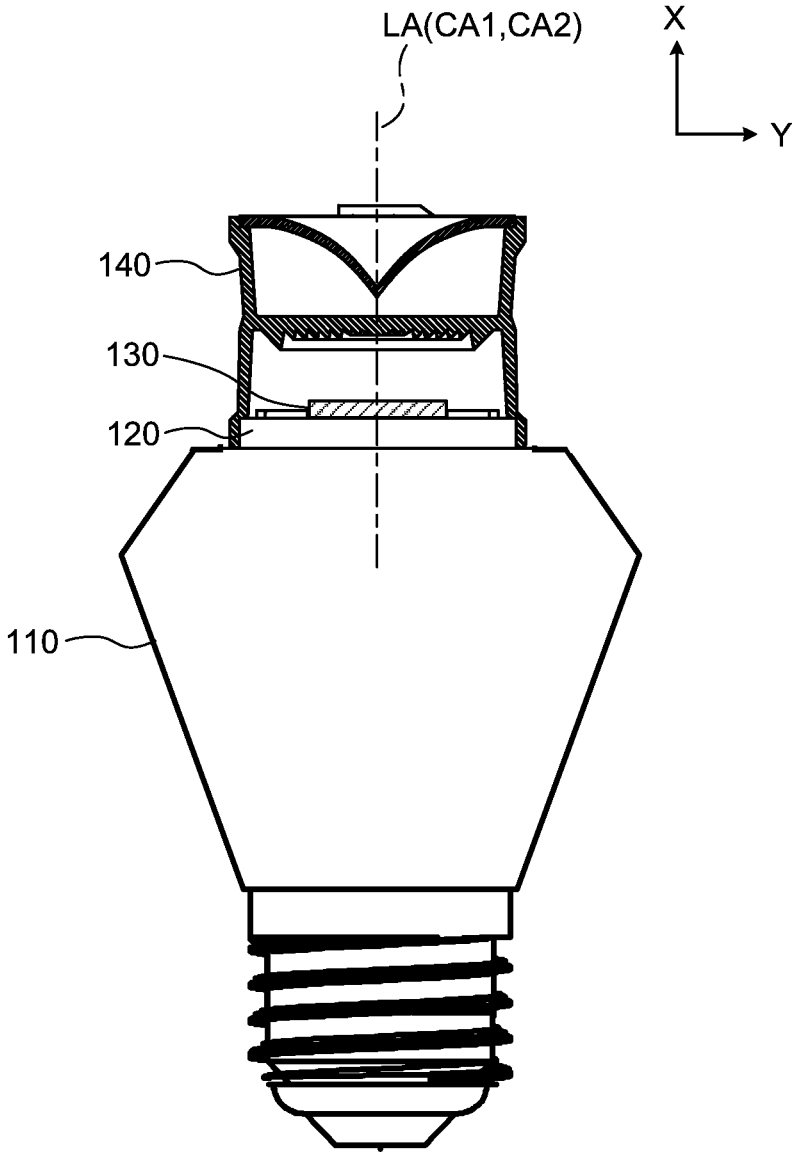
FIG. 8 is a schematic diagram illustrating the configuration of an illumination apparatus to be used for measuring the light distribution characteristics of the light flux controlling member.
Figure 9:
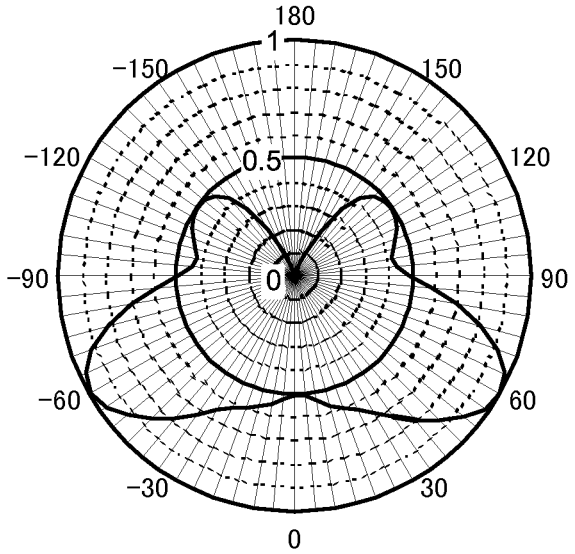
FIG. 9 is a graph illustrating the omnidirectional relative illuminance of the illumination apparatus illustrated in FIG. 8.

As illustrated in FIG. 8, the light distribution characteristics of light flux controlling member 140 were studied using an illumination apparatus not having cover 160. FIG. 9 is a graph illustrating the light distribution characteristics of the above illumination apparatus (light flux controlling member 140). In this graph, the relative illuminance in each direction is illustrated, with the maximum illuminance being set as "1" (the same also in the following graphs). Angle 0° means forward (upward direction in FIG. 8), angle 90° means sideward (horizontal direction in FIG. 8), and angle 180° means backward (downward direction in FIG. 8). With regard to the light distribution characteristics, in the above-mentioned graph, the range of an angle of 0° or more and 30° or less is also referred to as "forward," the range of an angle of more than 30° and 90° or less as "sideward," and the range of an angle of more than 90° and 180° or less as "backward." It is noted that, in the above graph, the relationship between the light distribution characteristics of a positive angle and a negative angle is linearly symmetric with respect to symmetry axis of 0°-180° line (optical axis LA).

It can be found from FIG. 9 that the distribution of light from light emitting element 130 is controlled by light flux controlling member 140, and that the amount of light sideward (about 60°) and backward (more than 120° and 150° or less) becomes larger, that the amount of light forward (0° or more and 30° or less) and backward (more than 90° and 120° or less) is relatively smaller, and that well-balanced light distribution cannot be performed only using light flux controlling member 140.

Example 1

Figure 10:
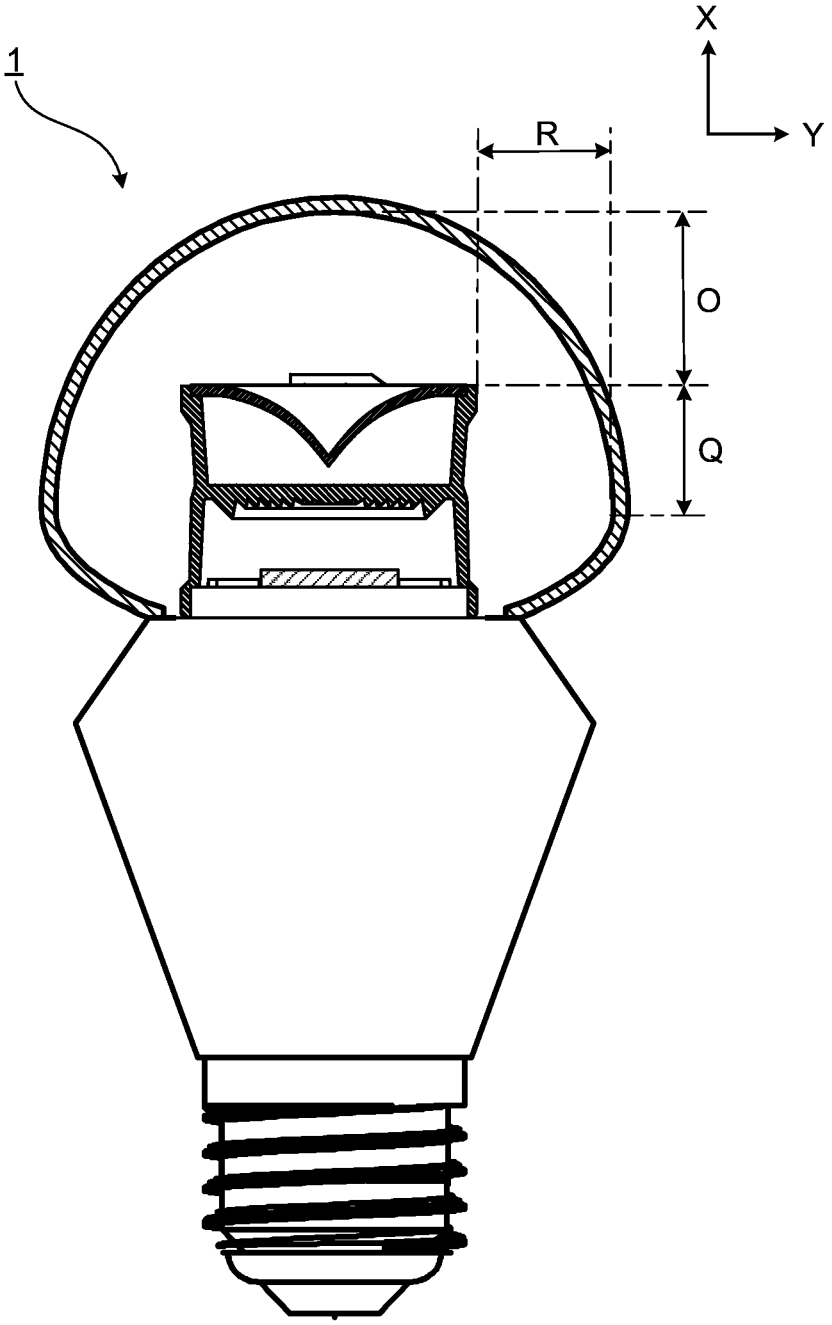
FIG. 10 is a schematic diagram illustrating the configuration of an illumination apparatus according to Example 1.

The light distribution characteristics of illumination apparatus 1 having a cover with such a shape as illustrated in FIG. 10 were determined. In illumination apparatus 1, the distance (O) in the direction X from a point (above-mentioned point P1), which is the most distant from the substrate, on the light flux controlling member to a point (above-mentioned point P2), which is the most distant from the substrate, on the inner surface of the cover is 17.8 mm. The distance (R) in the direction Y from a point (above-mentioned point P3), which is the most distant from the optical axis, on the light flux controlling member to a point (above-mentioned point P4) on the inner surface of the cover positioned at the same height of the reference surface for forming the total reflection surface is 13.44 mm. The distance (Q) in the direction X from point P1 to point P5 being the maximum diameter of the inner surface of the cover is 12.7 mm.

Figure 11:
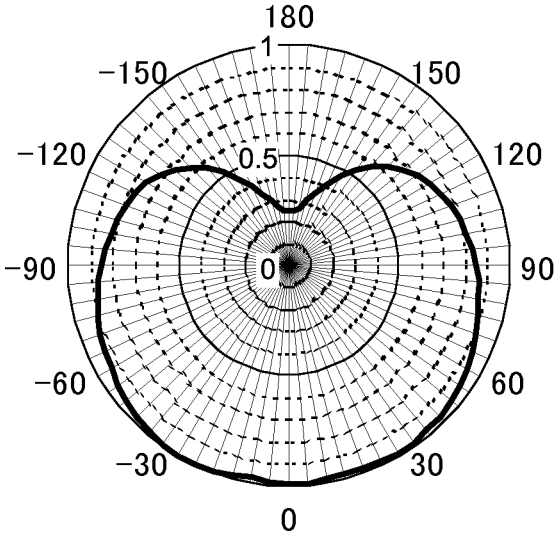
FIG. 11 is a graph illustrating the omnidirectional relative illuminance of the illumination apparatus according to Example 1.
Figure 12:
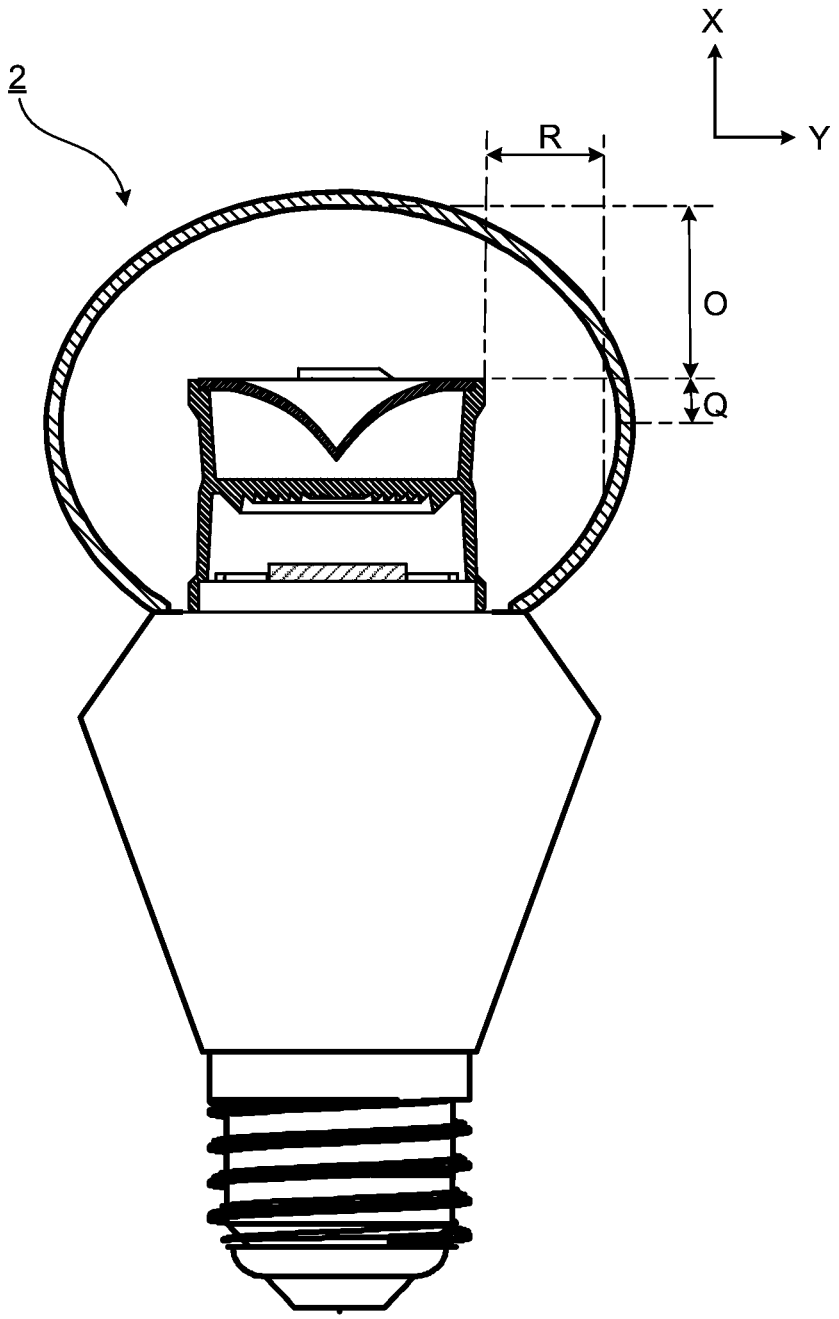
FIG. 12 is a schematic diagram illustrating the configuration of an illumination apparatus according to Example 2.
Figure 13:
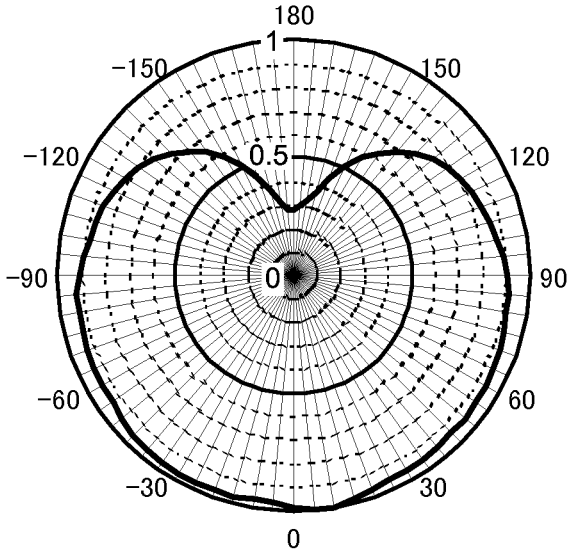
FIG. 13 is a graph illustrating the omnidirectional relative illuminance of the illumination apparatus according to Example 2.
Figure 14:
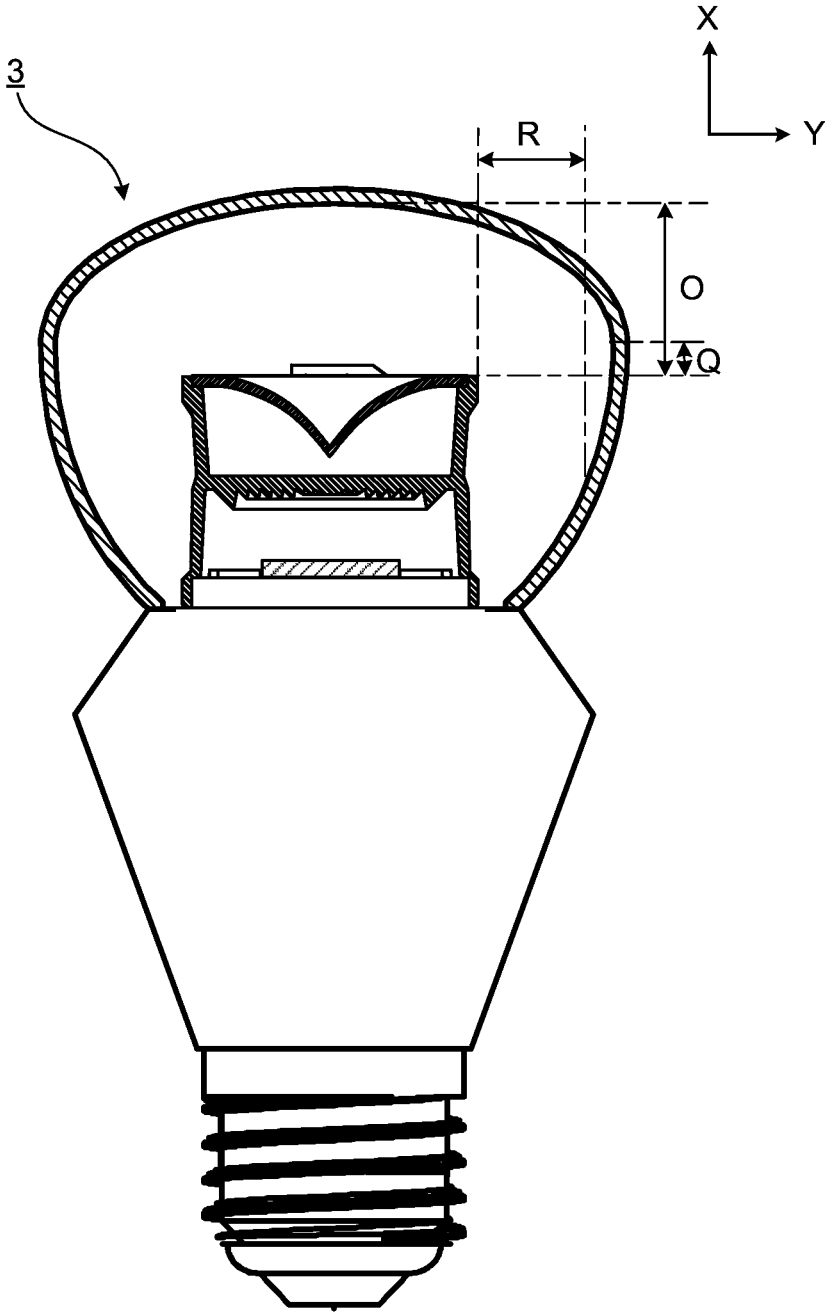
FIG. 14 is a schematic diagram illustrating the configuration of an illumination apparatus according to Example 3.
Figure 15:
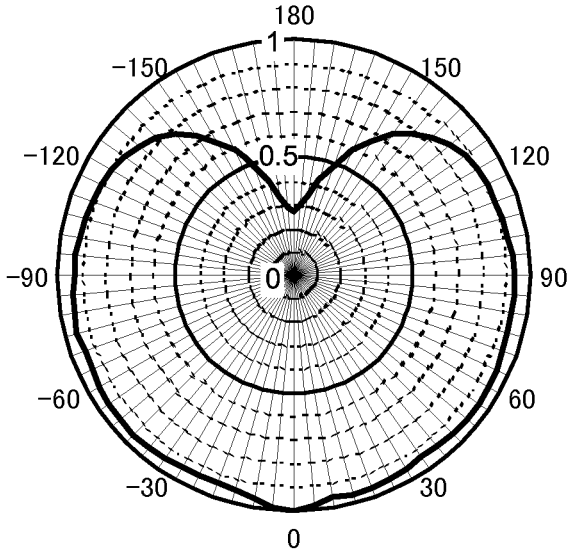
FIG. 15 is a graph illustrating the omnidirectional relative illuminance of the illumination apparatus according to Example 3.
Figure 16:
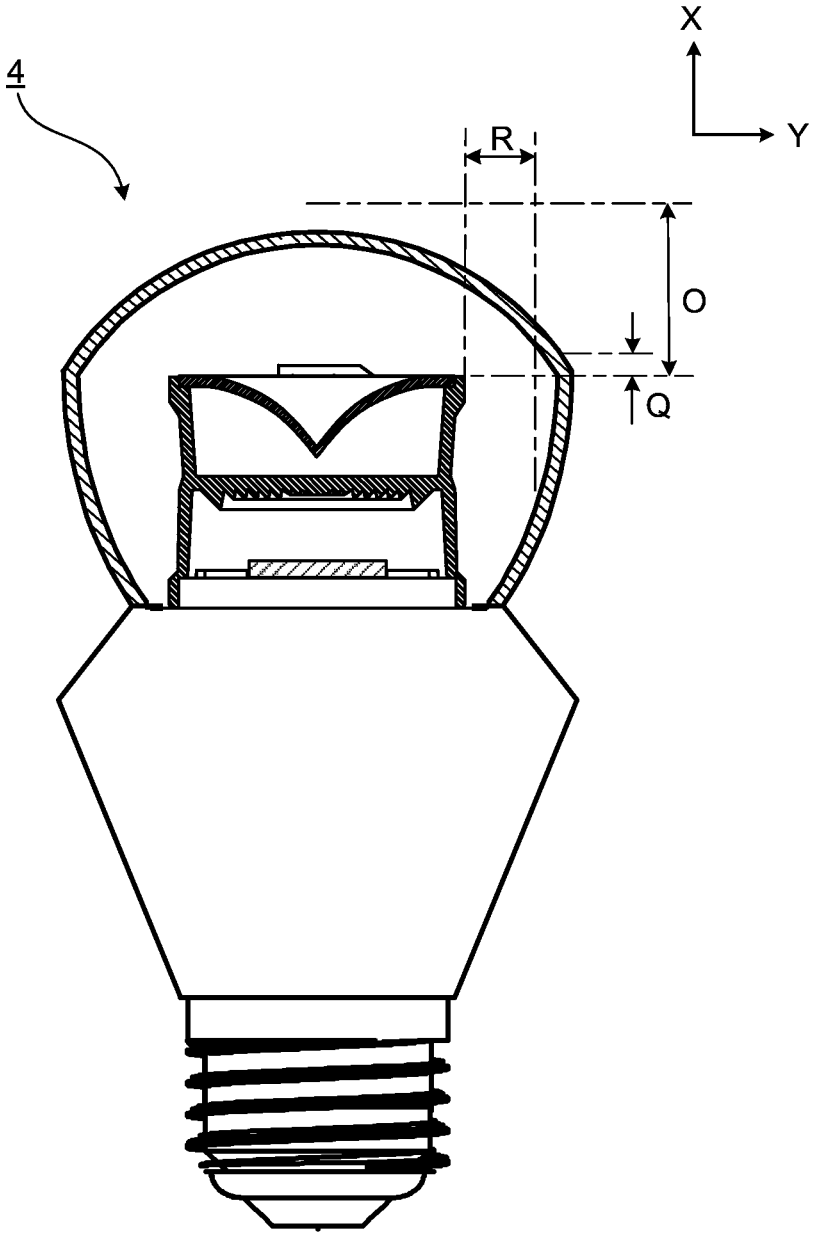
FIG. 16 is a schematic diagram illustrating the configuration of an illumination apparatus according to Example 4.
Figure 17:
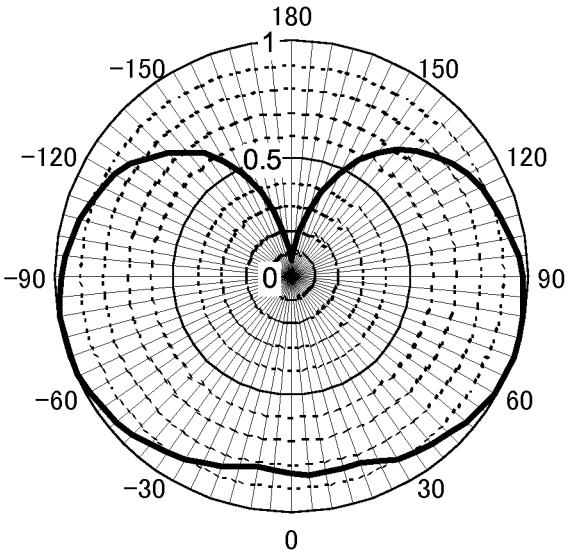
FIG. 17 is a graph illustrating the omnidirectional relative illuminance of the illumination apparatus according to Example 4.
Figure 18:
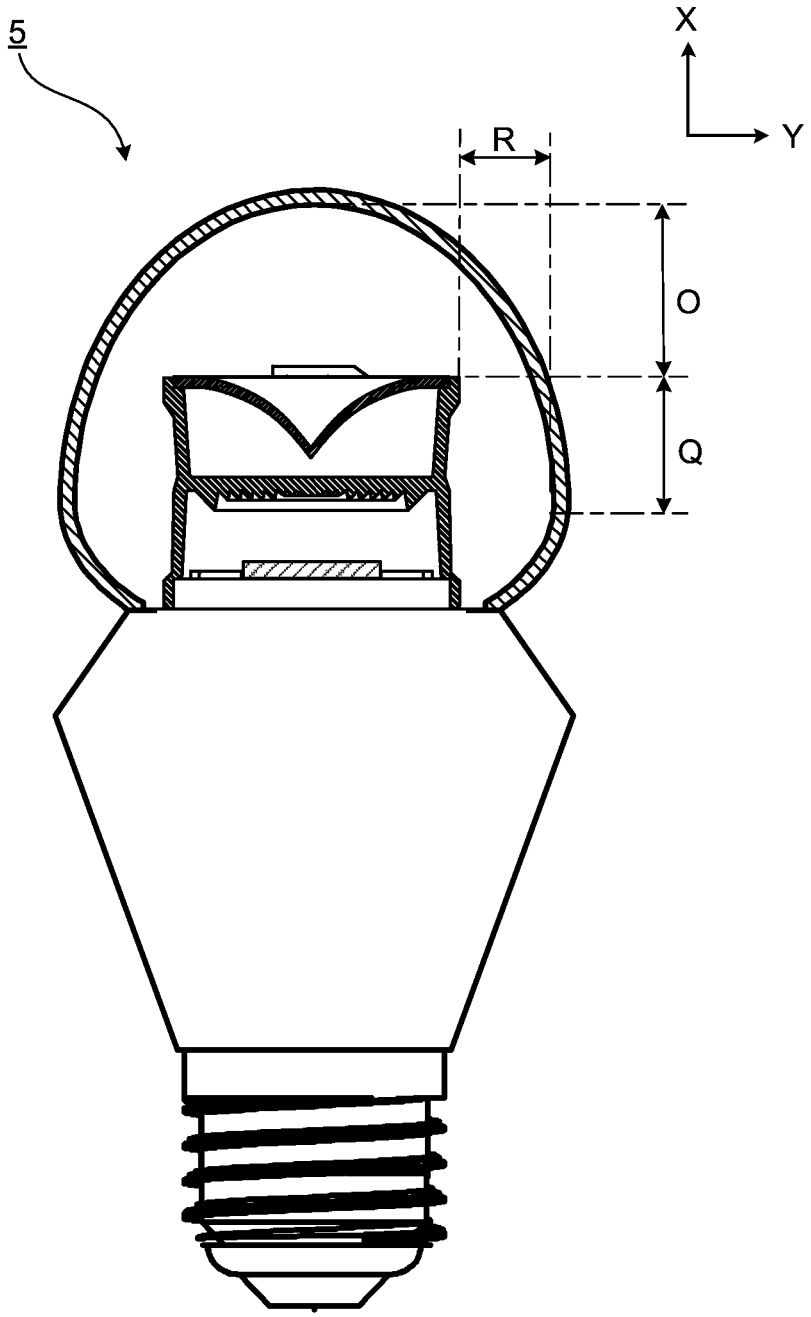
FIG. 18 is a schematic diagram illustrating the configuration of an illumination apparatus according to Example 5.
Figure 19:
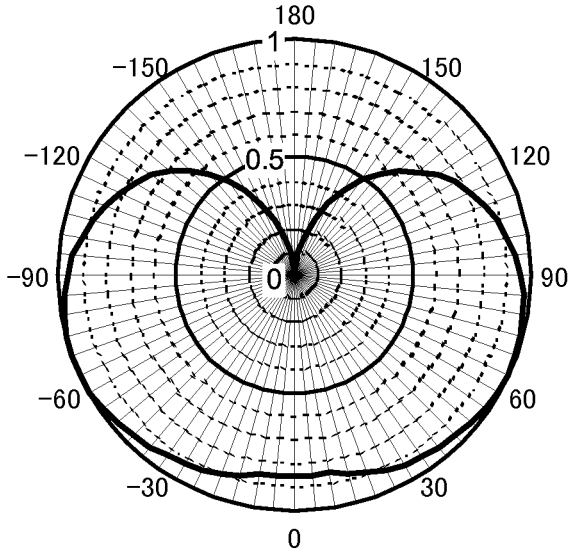
FIG. 19 is a graph illustrating the omnidirectional relative illuminance of the illumination apparatus according to Example 5.
Figure 20:
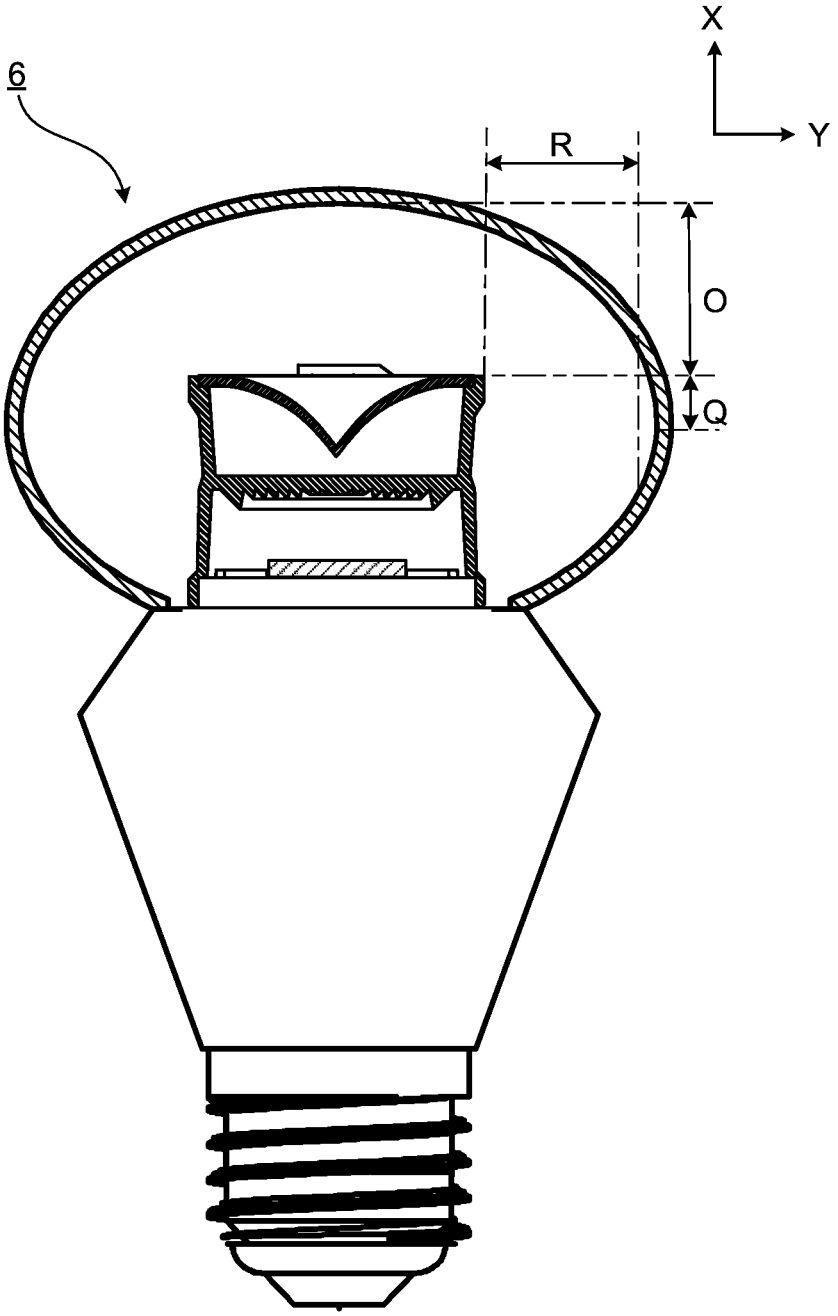
FIG. 20 is a schematic diagram illustrating the configuration of an illumination apparatus according to Example 6.
Figure 21:
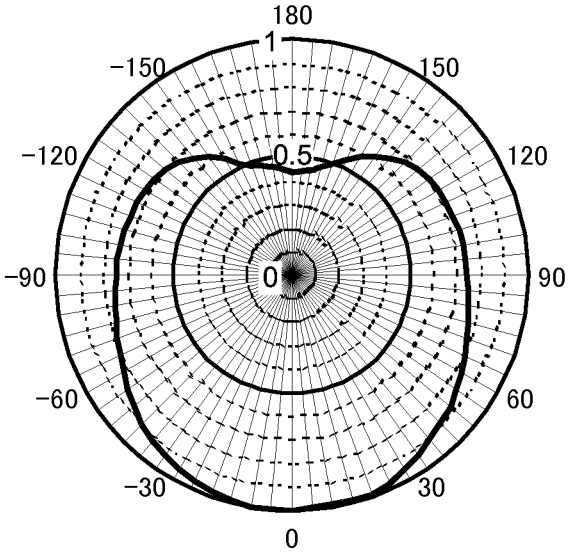
FIG. 21 is a graph illustrating the omnidirectional relative illuminance of the illumination apparatus according to Example 6.
Figure 22:
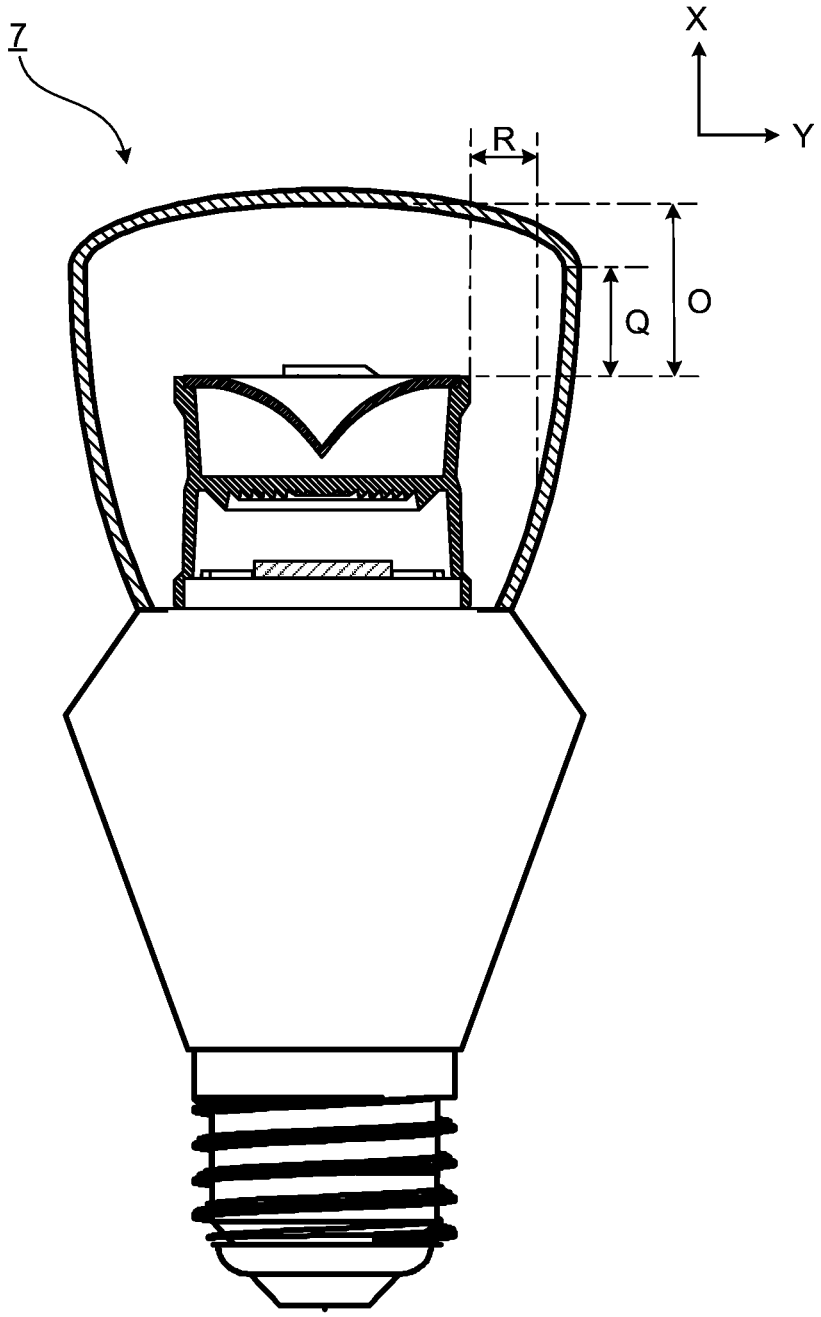
FIG. 22 is a schematic diagram illustrating the configuration of an illumination apparatus according to Example 7.
Figure 23:
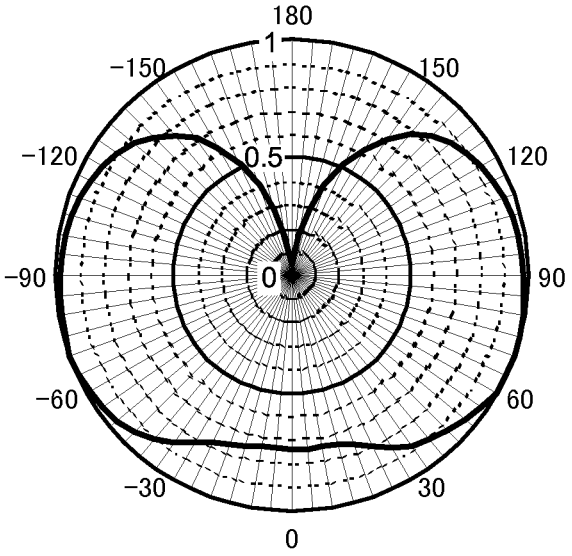
FIG. 23 is a graph illustrating the omnidirectional relative illuminance of the illumination apparatus according to Example 7.
Figure 24:
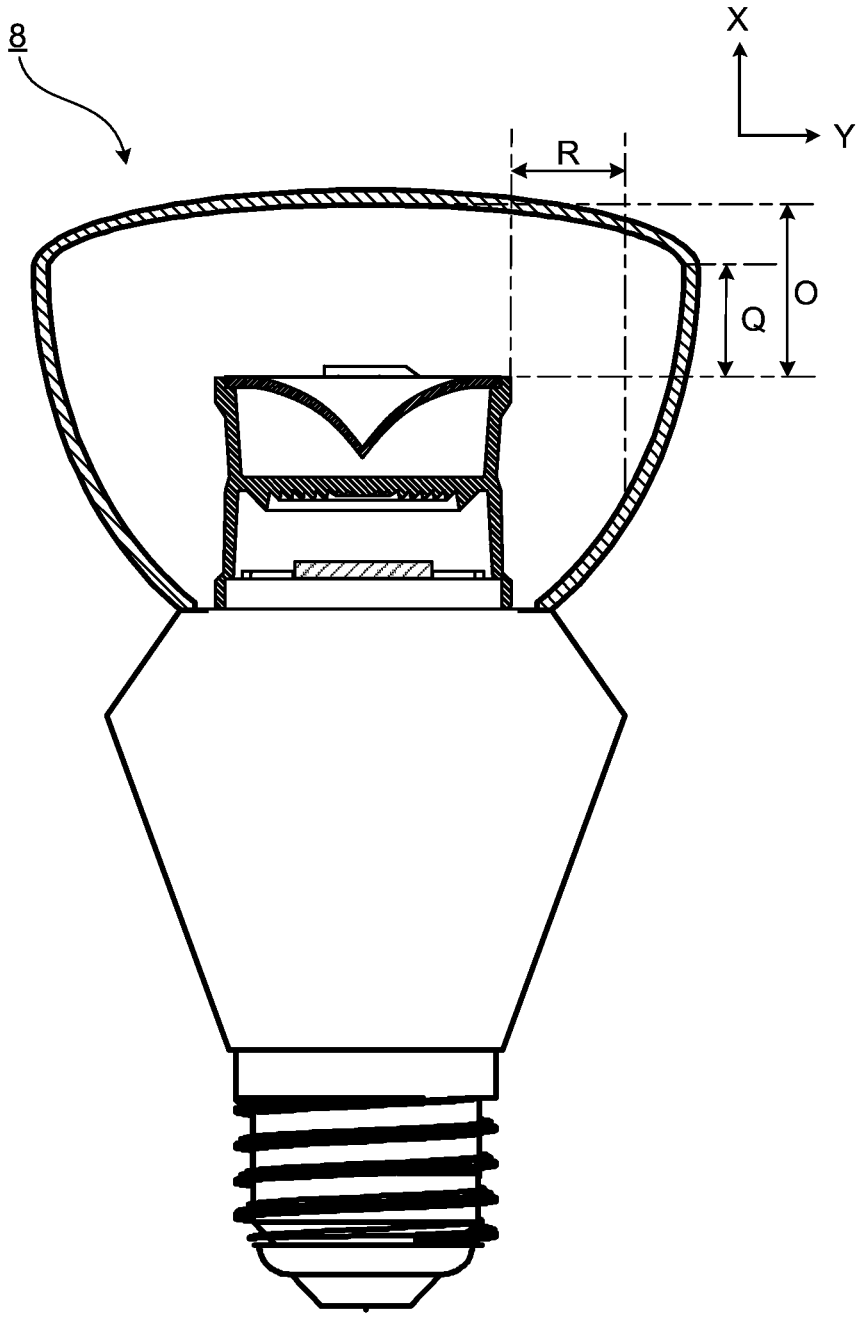
FIG. 24 is a schematic diagram illustrating the configuration of an illumination apparatus according to Example 8.
Figure 25:
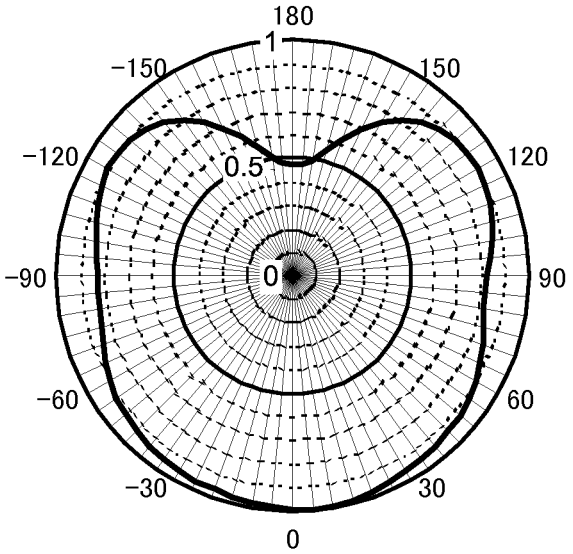
FIG. 25 is a graph illustrating the omnidirectional relative illuminance of the illumination apparatus according to Example 8.
Figure 26:
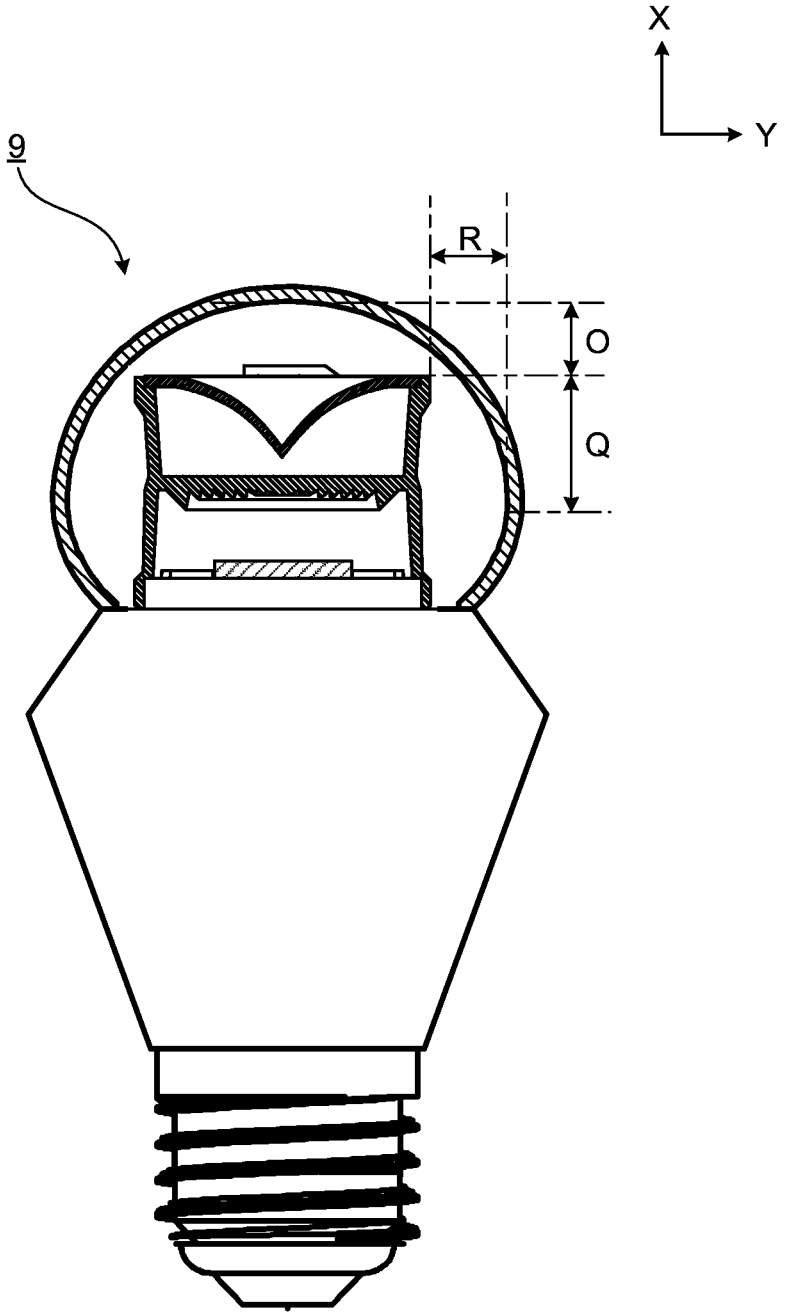
FIG. 26 is a schematic diagram illustrating the configuration of an illumination apparatus according to Example 9.
Figure 27:
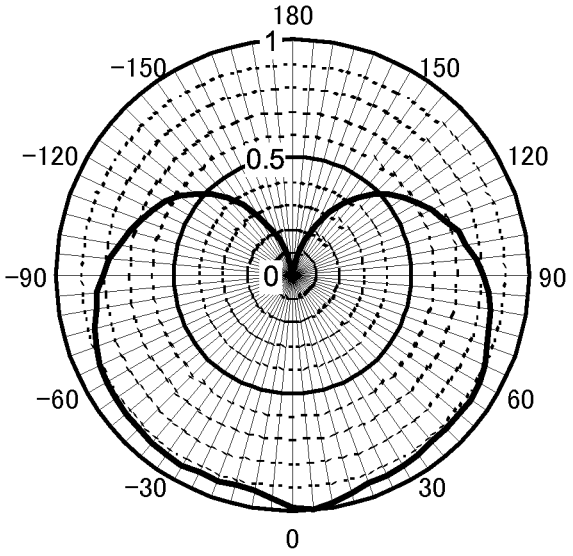
FIG. 27 is a graph illustrating the omnidirectional relative illuminance of the illumination apparatus according to Example 9.
Figure 28:
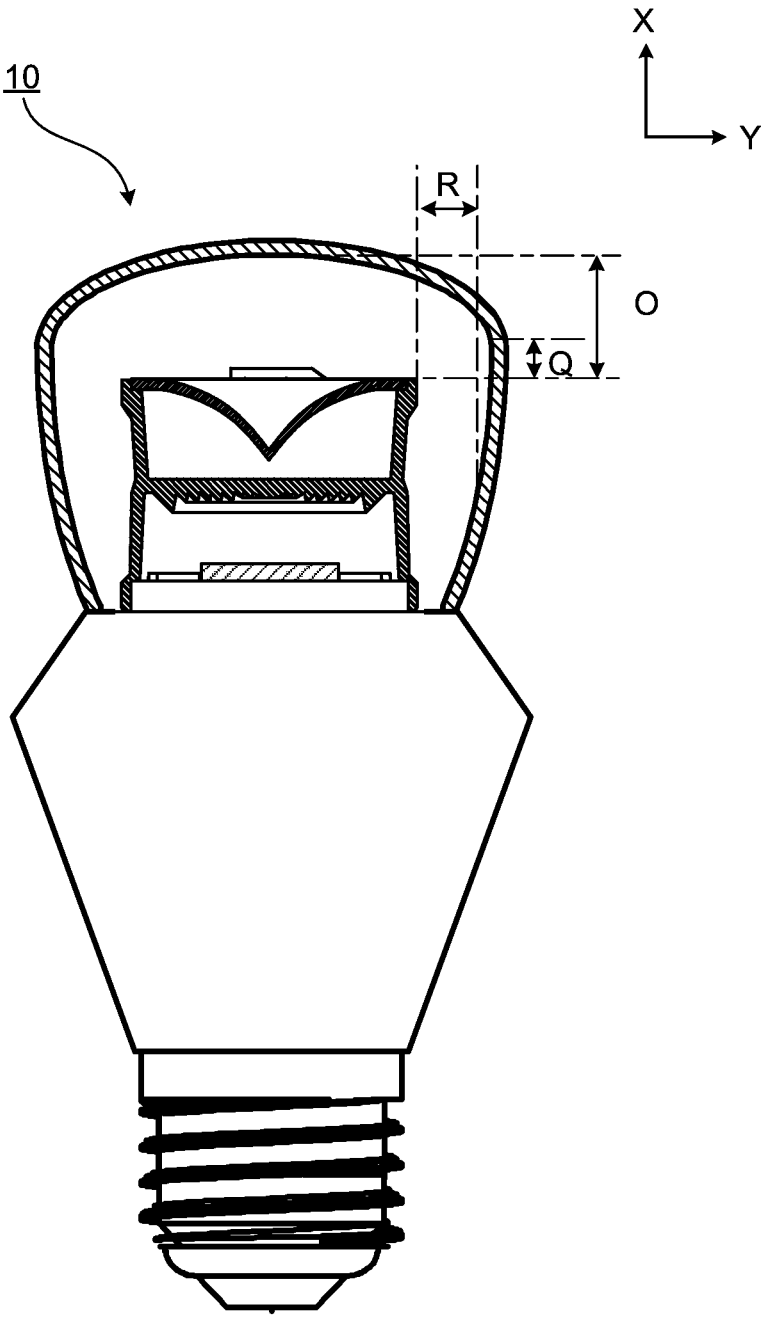
FIG. 28 is a schematic diagram illustrating the configuration of an illumination apparatus according to Example 10.
Figure 29:
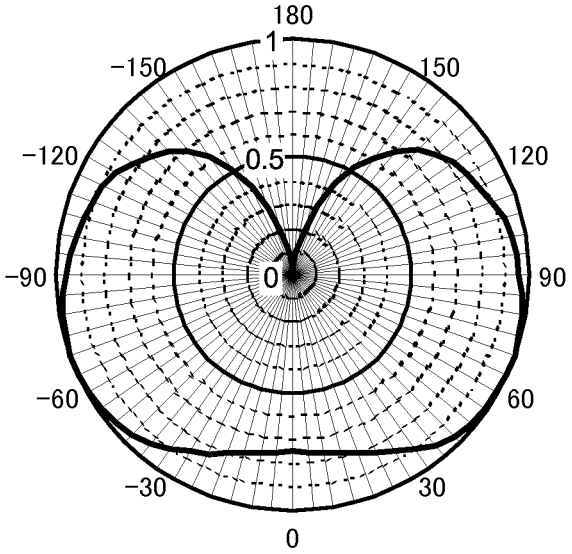
FIG. 29 is a graph illustrating the omnidirectional relative illuminance of the illumination apparatus according to Example 10.
Figure 30:
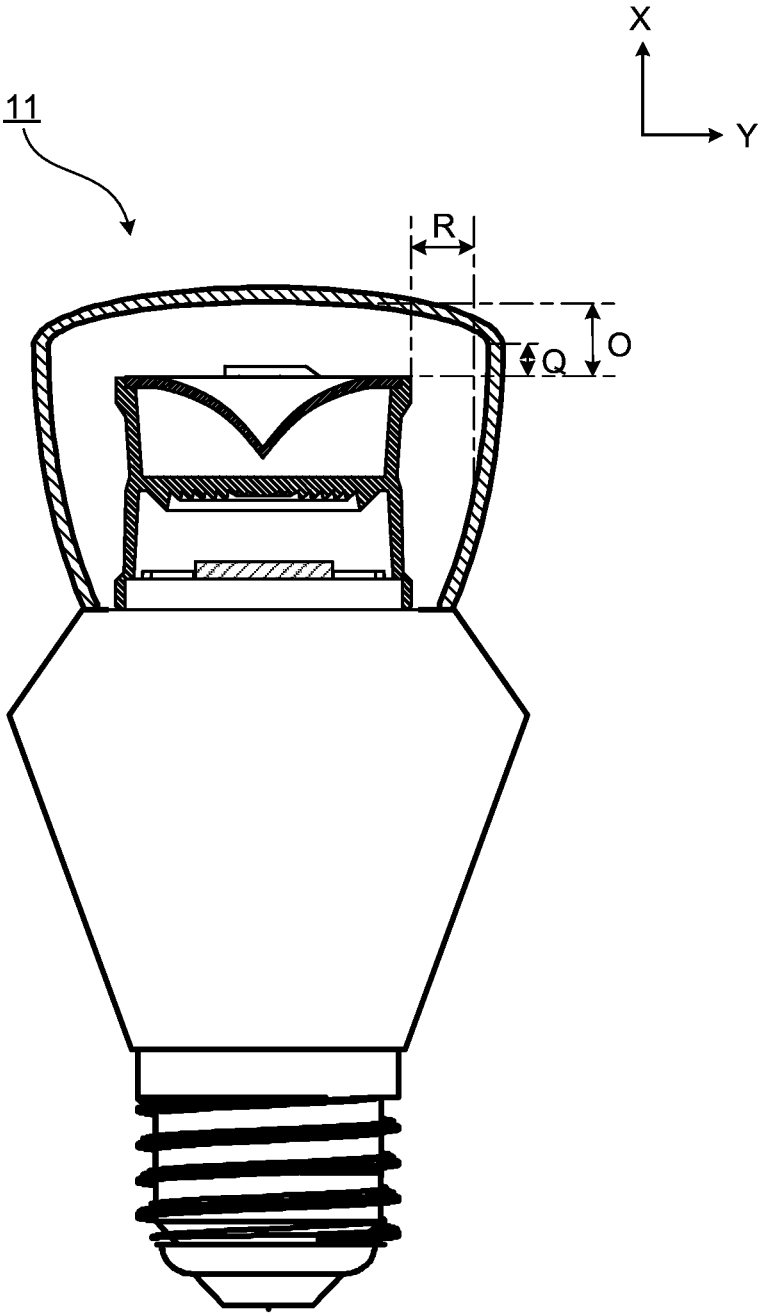
FIG. 30 is a schematic diagram illustrating the configuration of an illumination apparatus according to Example 11.
Figure 31:
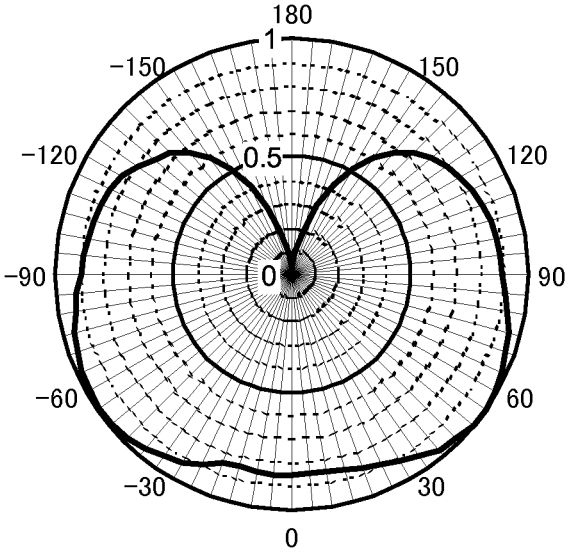
FIG. 31 is a graph illustrating the omnidirectional relative illuminance of the illumination apparatus according to Example 11.
Figure 32:
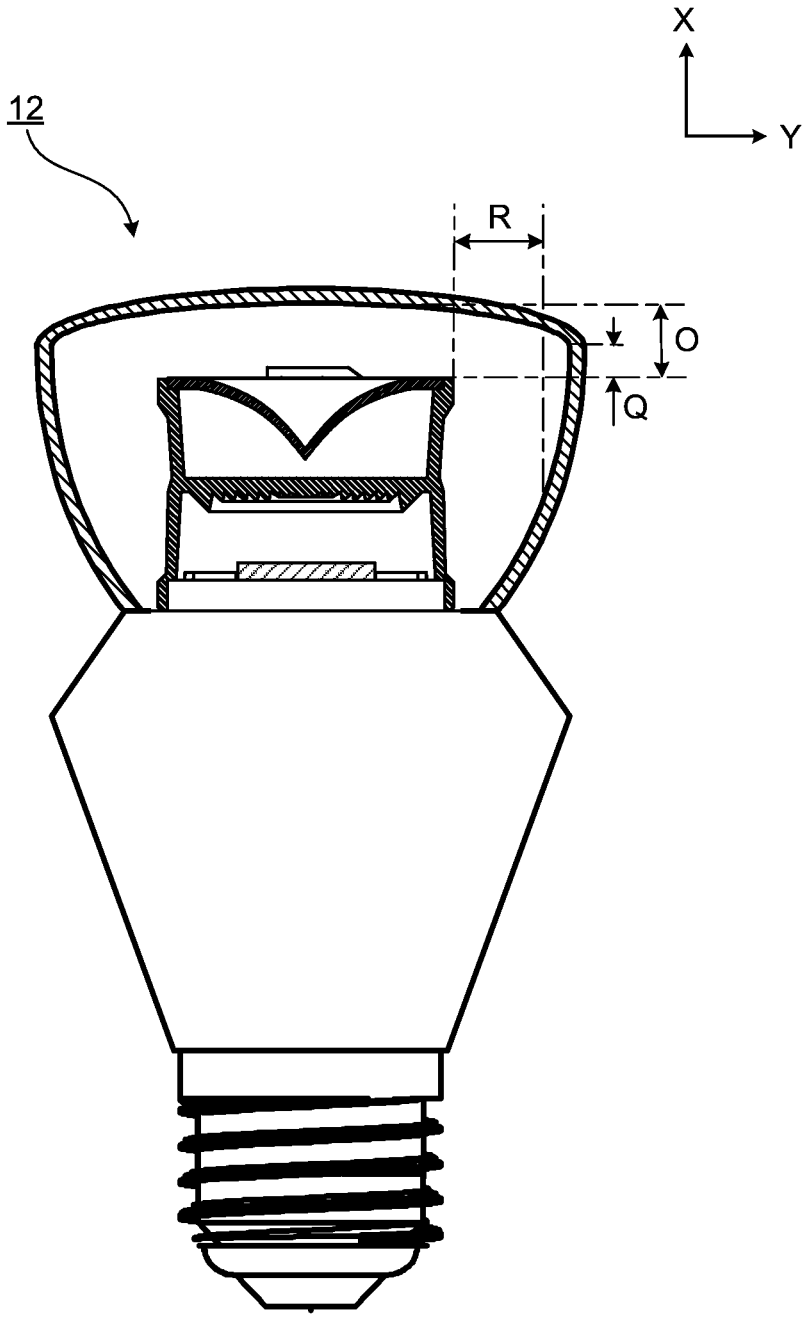
FIG. 32 is a schematic diagram illustrating the configuration of an illumination apparatus according to Example 12.
Figure 33:
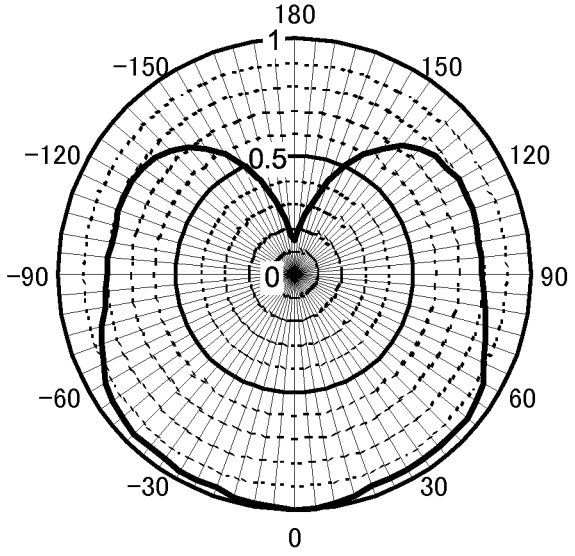
FIG. 33 is a graph illustrating the omnidirectional relative illuminance of the illumination apparatus according to Example 12.
Figure 34:
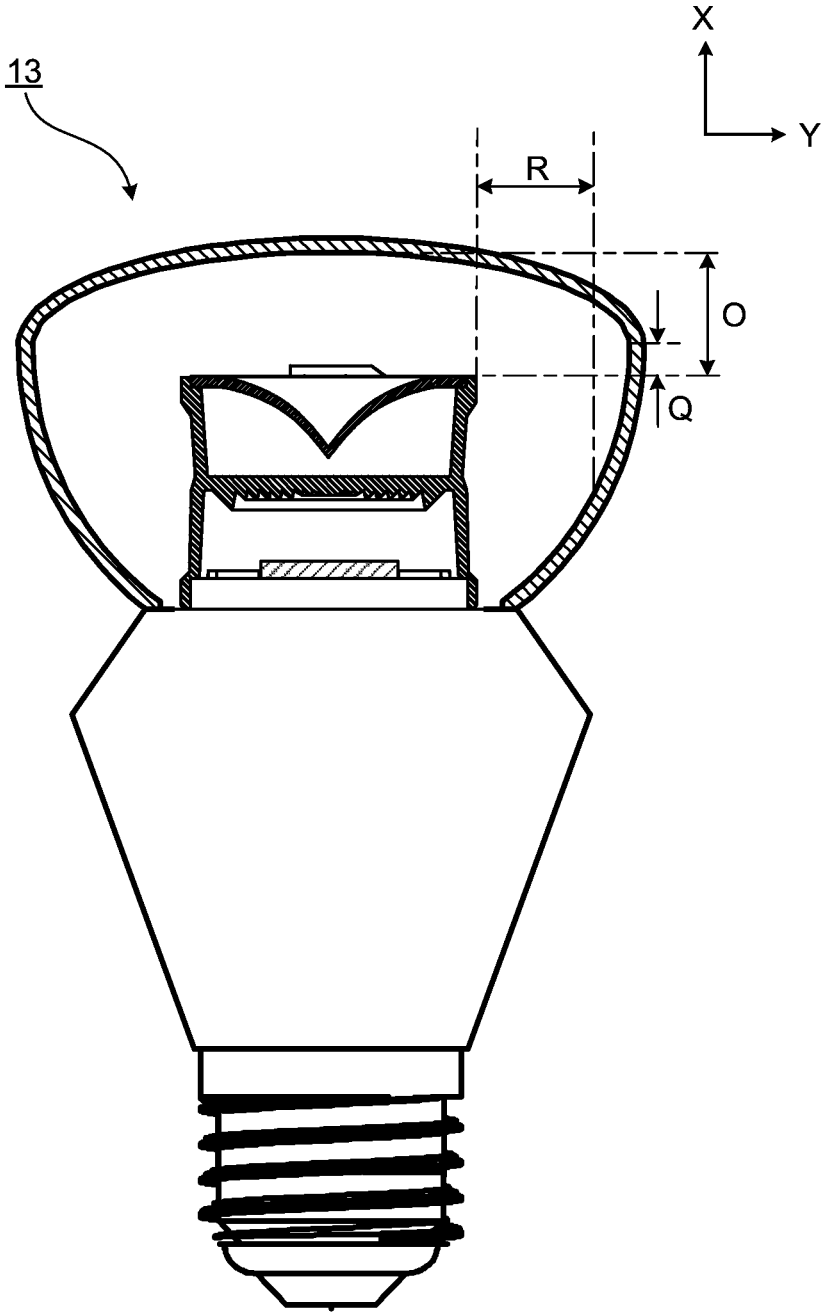
FIG. 34 is a schematic diagram illustrating the configuration of an illumination apparatus according to Example 13.
Figure 35:
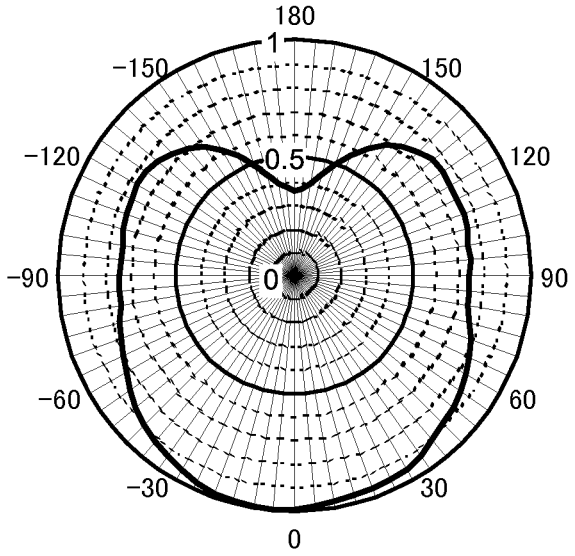
FIG. 35 is a graph illustrating the omnidirectional relative illuminance of the illumination apparatus according to Example 13.
Figure 36:
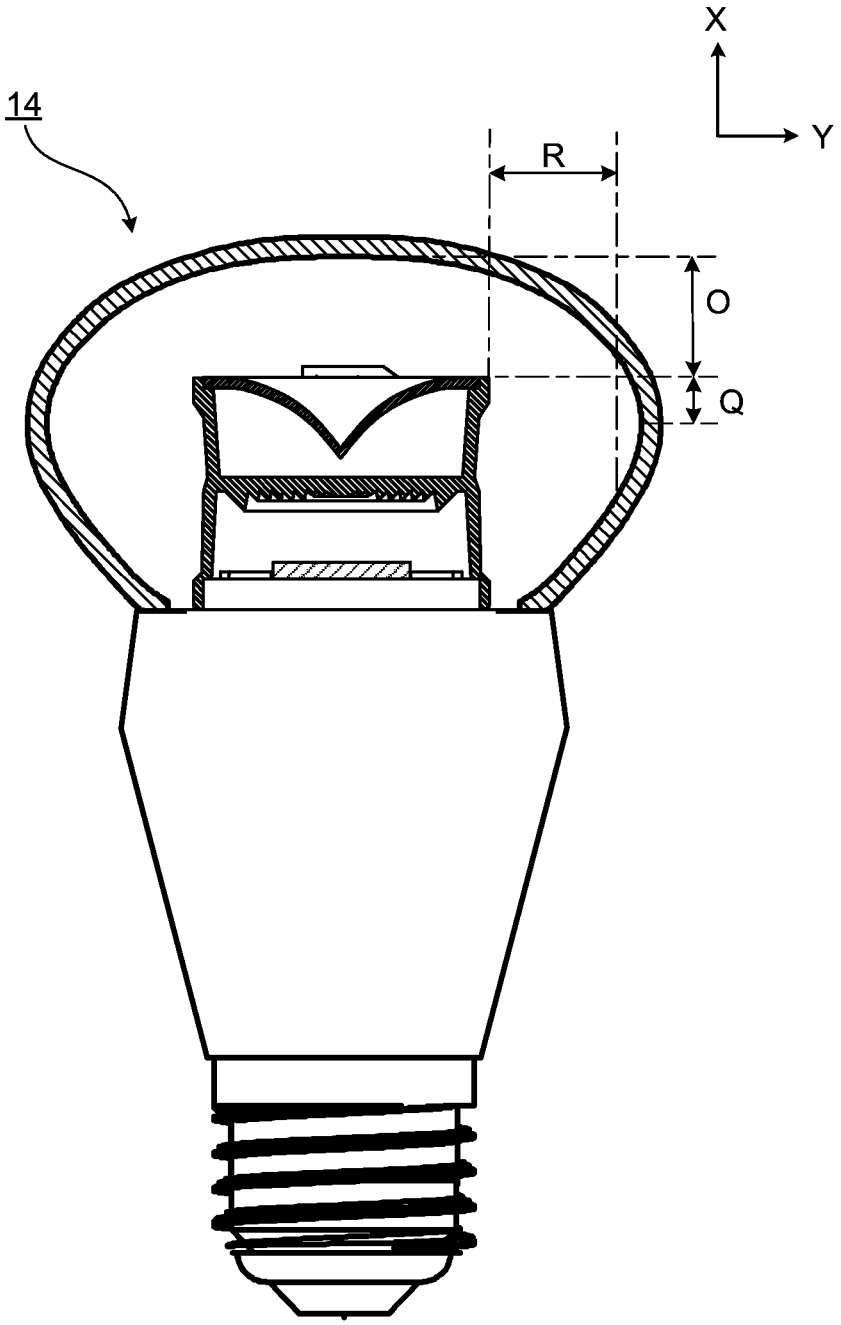
FIG. 36 is a schematic diagram illustrating the configuration of an illumination apparatus according to Example 14.
Figure 37:
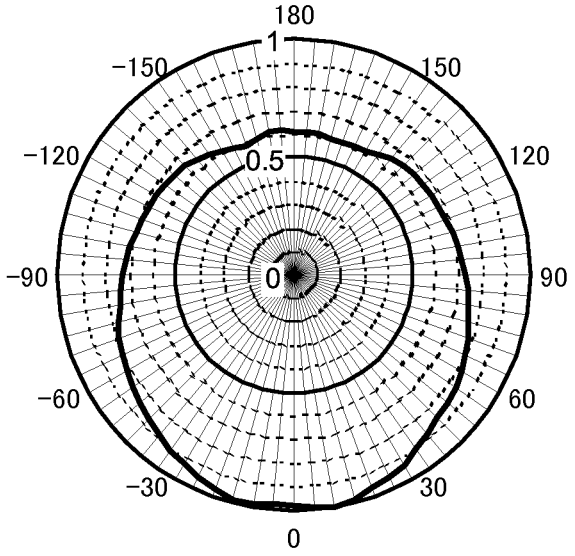
FIG. 37 is a graph illustrating the omnidirectional relative illuminance of the illumination apparatus according to Example 14.
Figure 38:
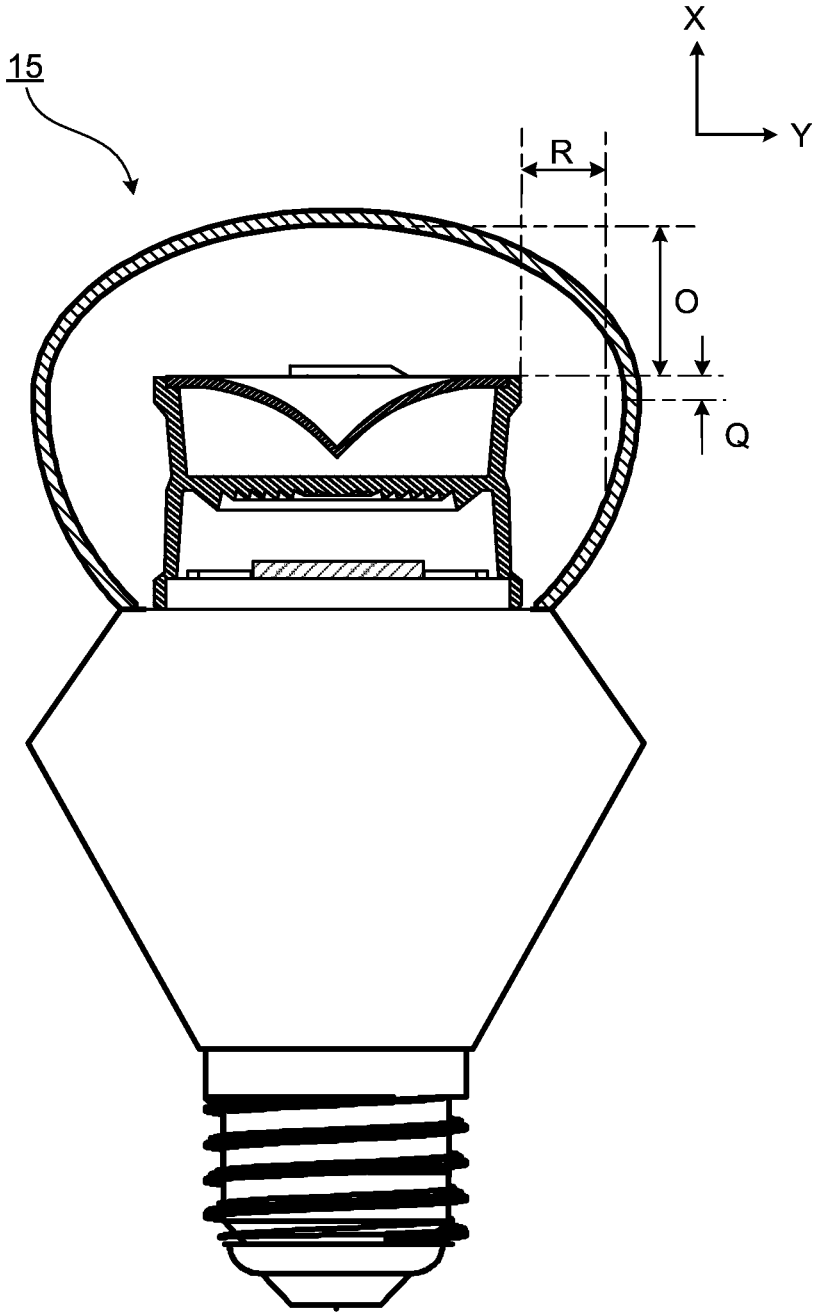
FIG. 38 is a schematic diagram illustrating the configuration of an illumination apparatus according to Example 15.
Figure 39:
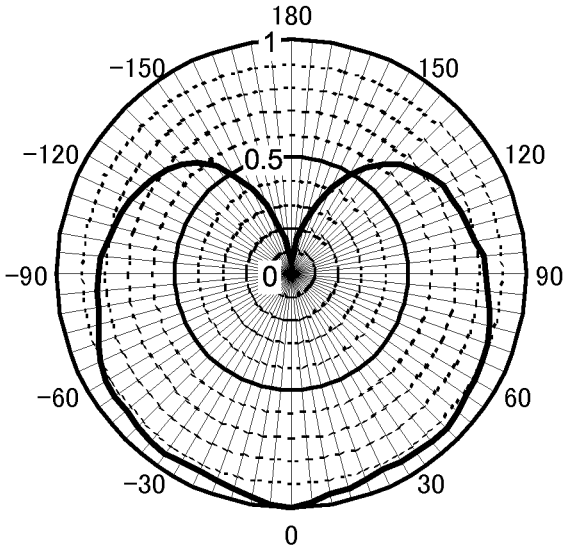
FIG. 39 is a graph illustrating the omnidirectional relative illuminance of the illumination apparatus according to Example 15.
Figure 40:
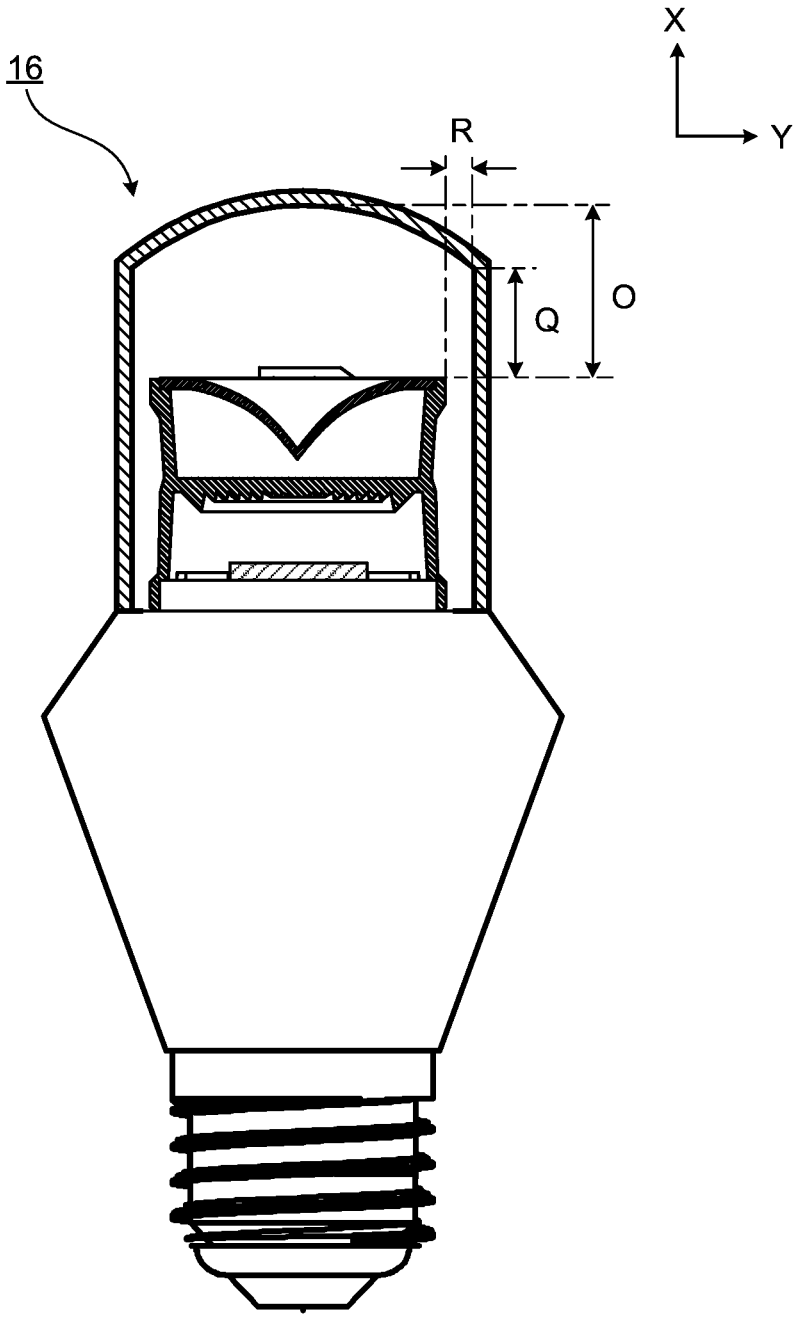
FIG. 40 is a schematic diagram illustrating the configuration of an illumination apparatus according to Comparative Example 1.
Figure 41:
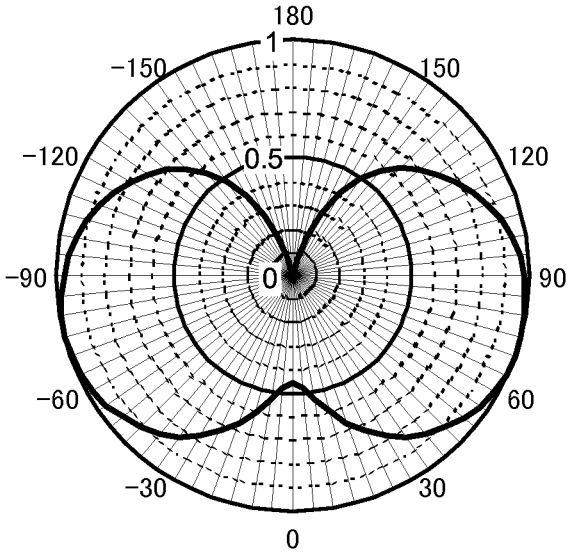
FIG. 41 is a graph illustrating the omnidirectional relative illuminance of the illumination apparatus according to Comparative Example 1.
Figure 42:
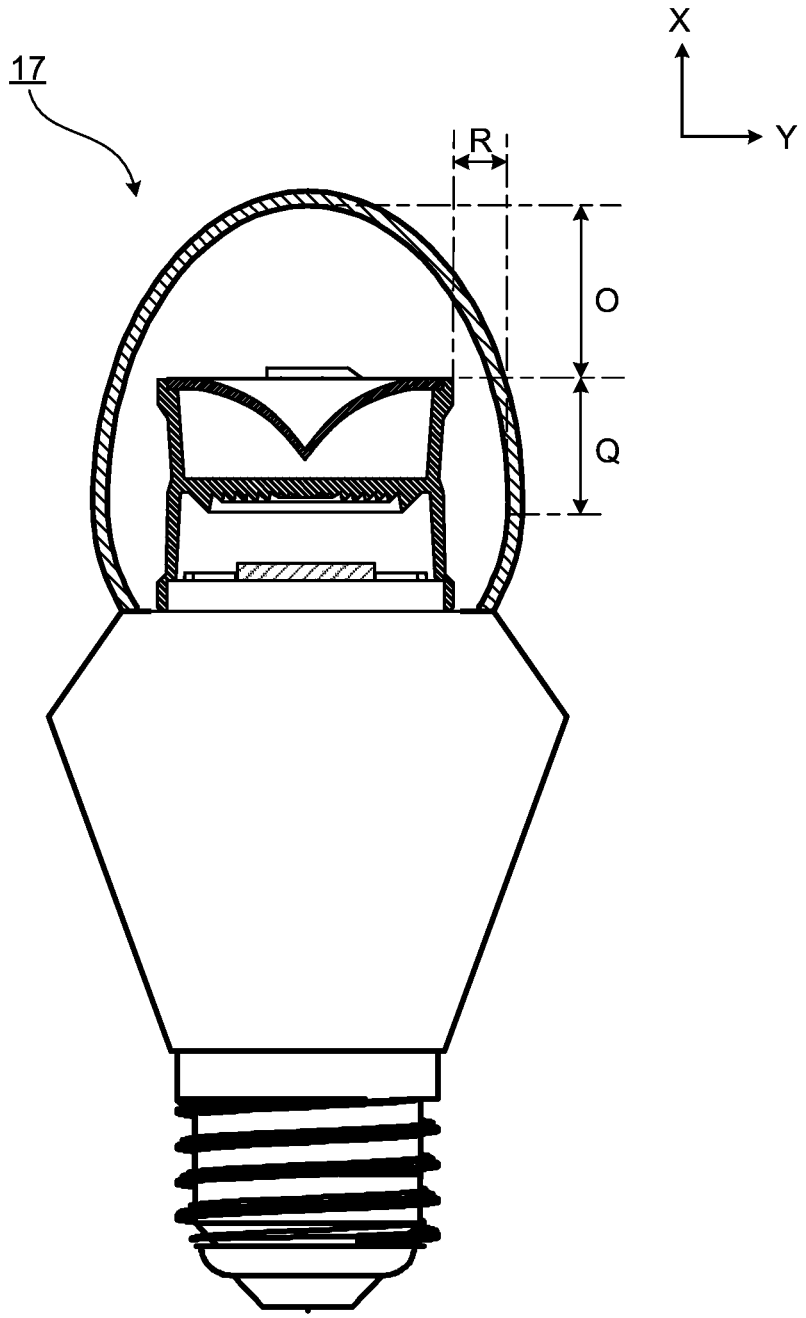
FIG. 42 is a schematic diagram illustrating the configuration of an illumination apparatus according to Comparative Example 2.
Figure 43:
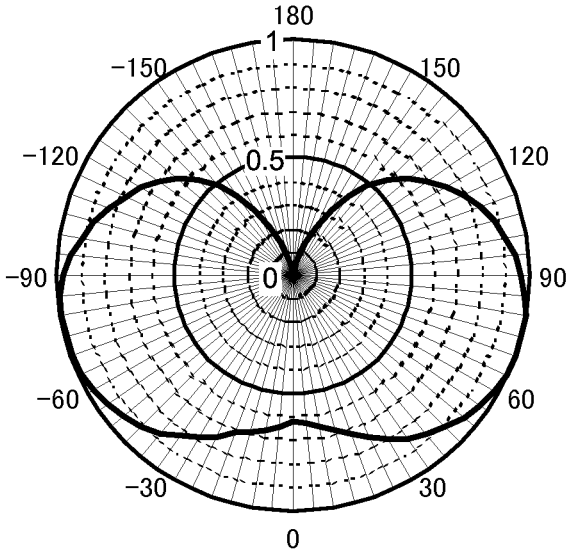
FIG. 43 is a graph illustrating the omnidirectional relative illuminance of the illumination apparatus according to Comparative Example 2.
Figure 44:
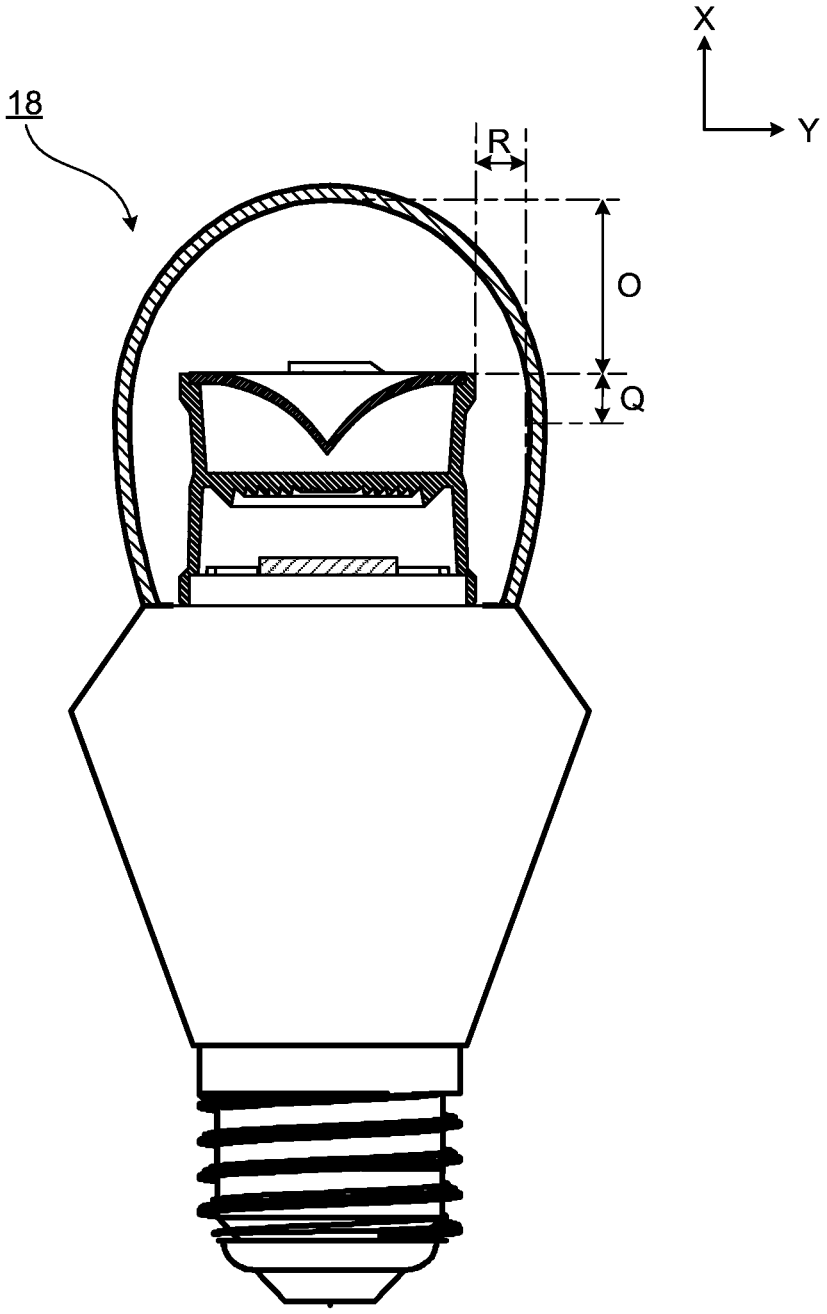
FIG. 44 is a schematic diagram illustrating the configuration of an illumination apparatus according to Comparative Example 3.
Figure 45:
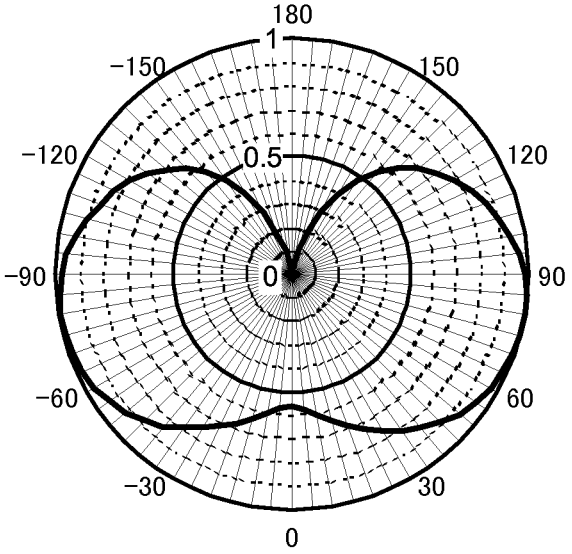
FIG. 45 is a graph illustrating the omnidirectional relative illuminance of the illumination apparatus according to Comparative Example 3.
Figure 46:
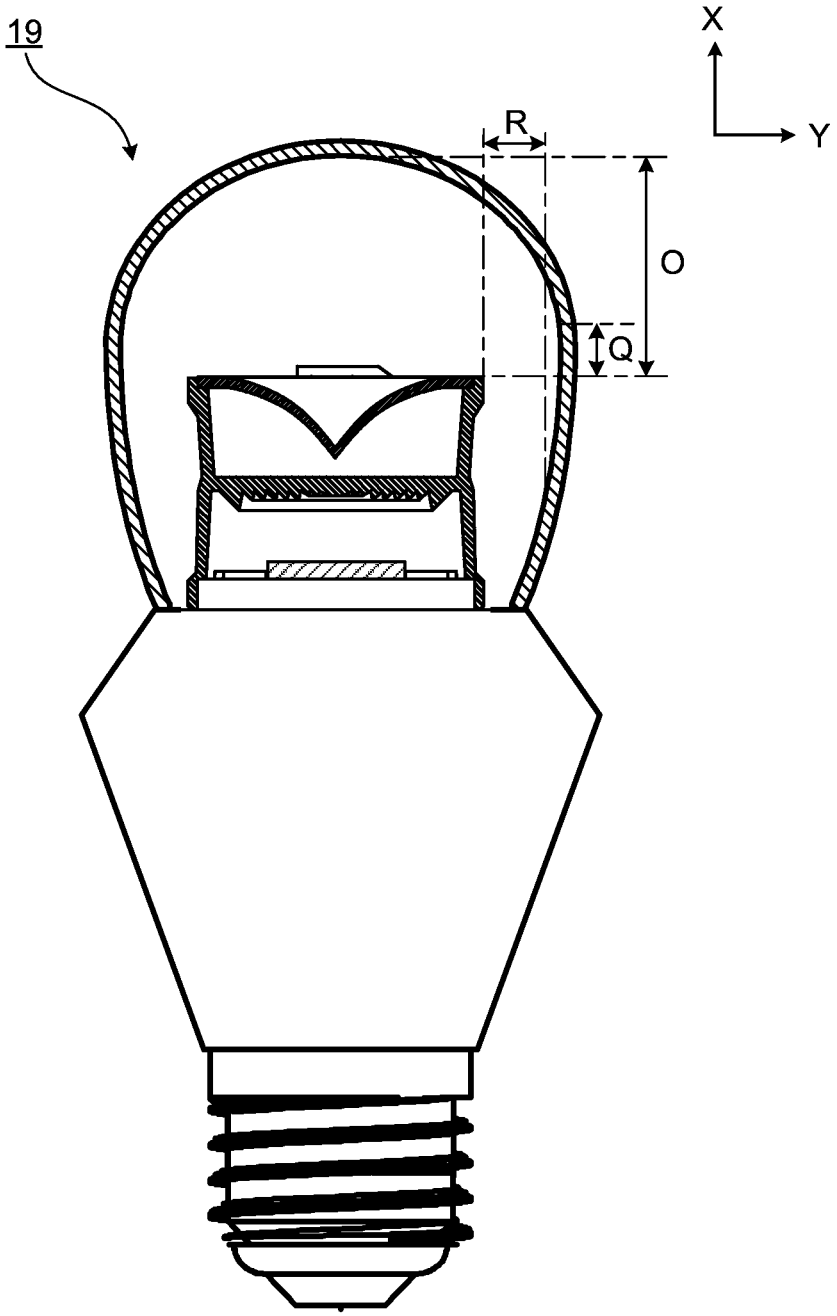
FIG. 46 is a schematic diagram illustrating the configuration of an illumination apparatus according to Comparative Example 4.
Figure 47:
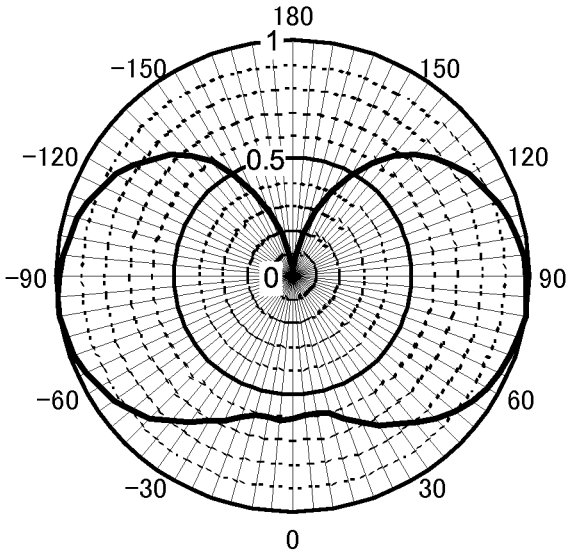
FIG. 47 is a graph illustrating the omnidirectional relative illuminance of the illumination apparatus according to Comparative Example 4.
Figure 48:
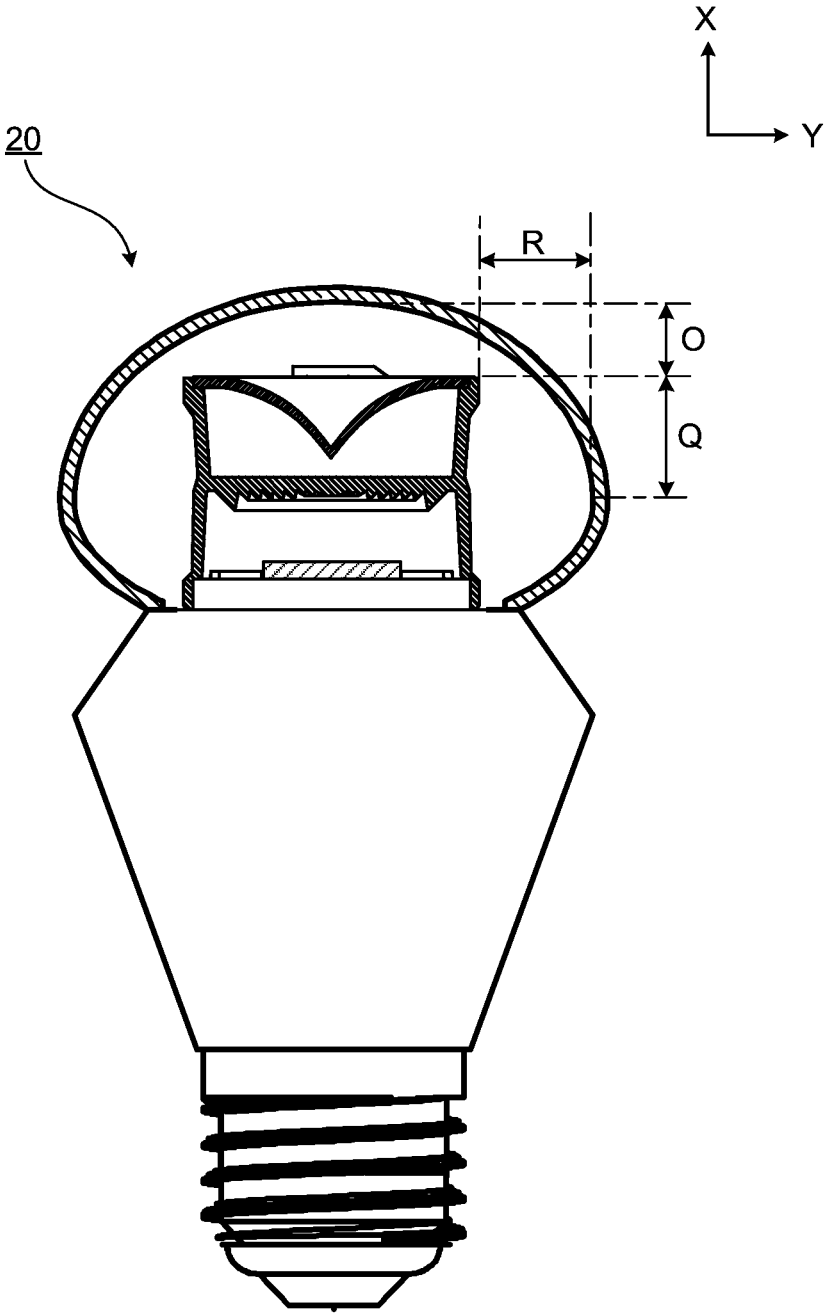
FIG. 48 is a schematic diagram illustrating the configuration of an illumination apparatus according to Comparative Example 5.
Figure 49:
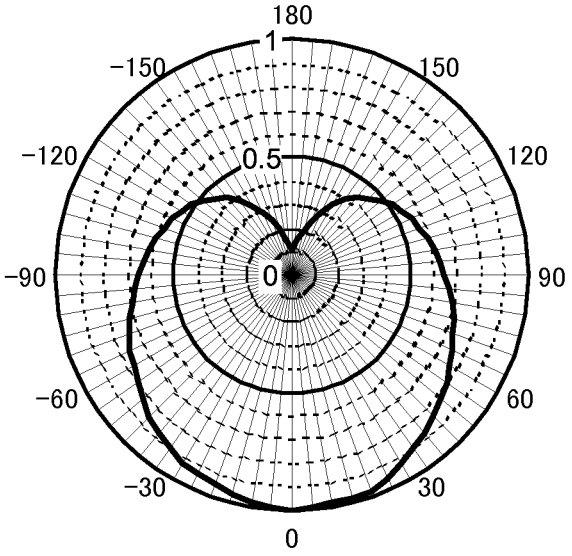
FIG. 49 is a graph illustrating the omnidirectional relative illuminance of the illumination apparatus according to Comparative Example 5.
Figure 50:
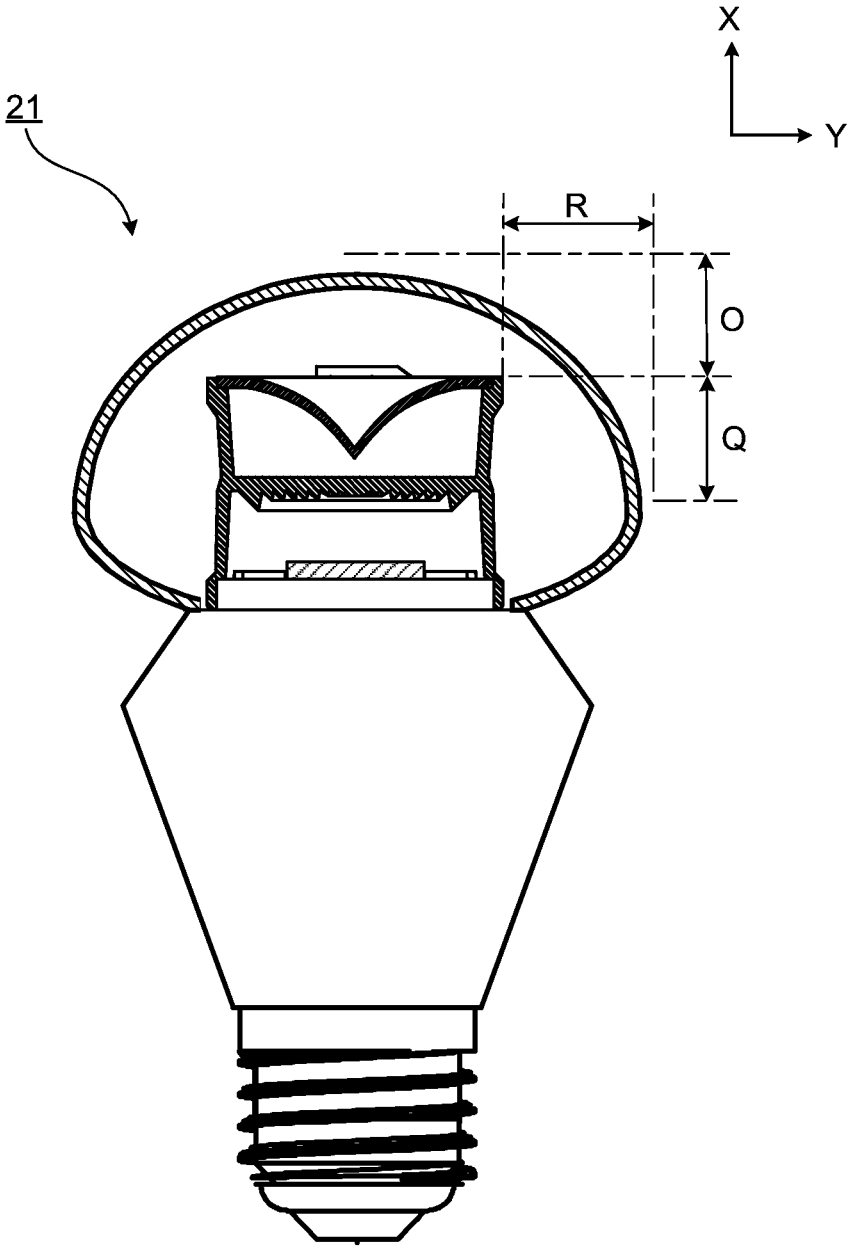
FIG. 50 is a schematic diagram illustrating the configuration of an illumination apparatus according to Comparative Example 6.
Figure 51:
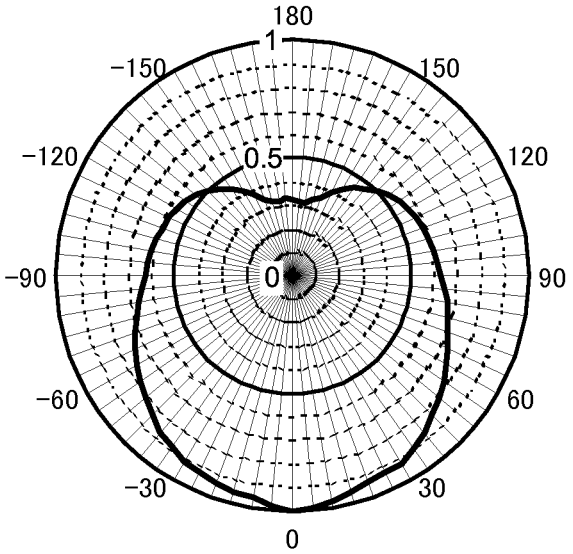
FIG. 51 is a graph illustrating the omnidirectional relative illuminance of the illumination apparatus according to Comparative Example 6.
Figure 52:
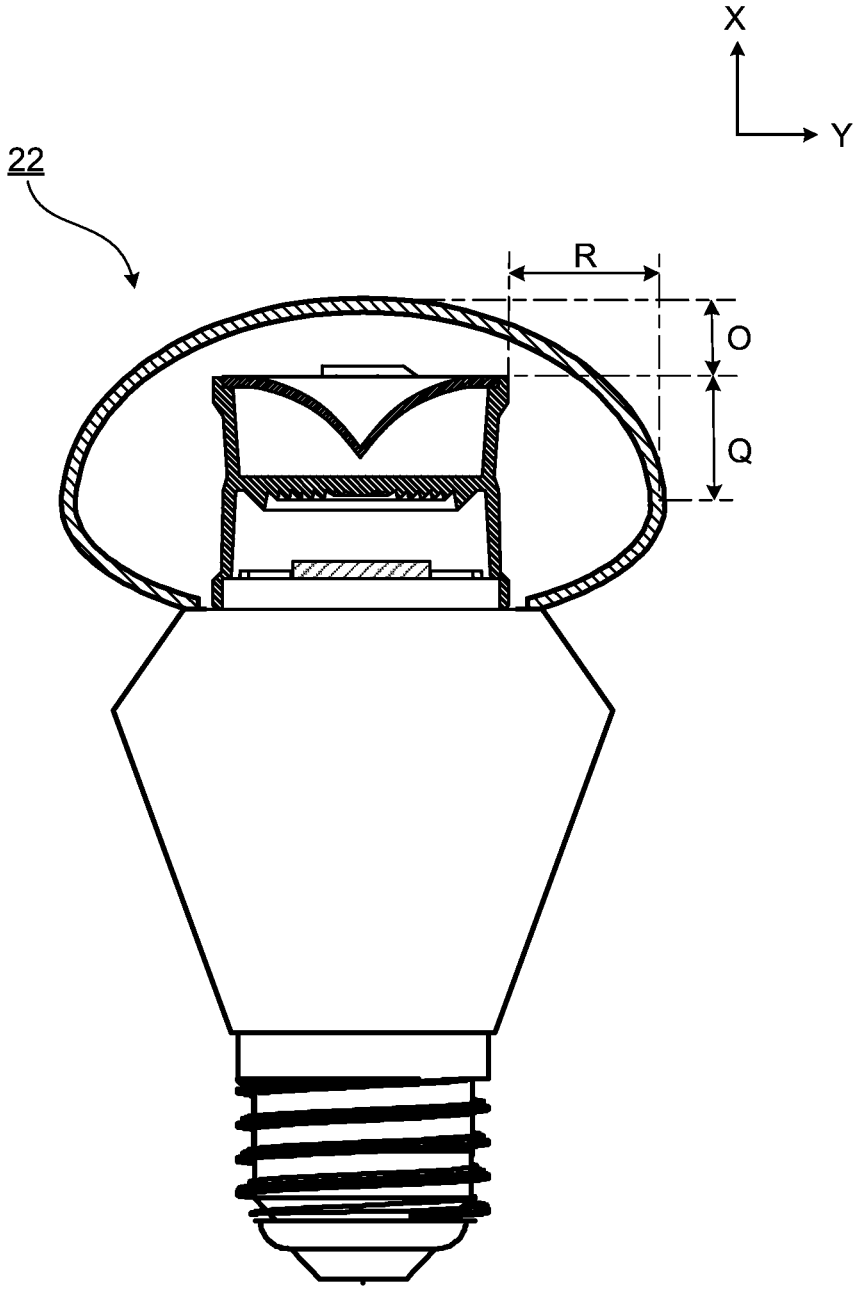
FIG. 52 is a schematic diagram illustrating the configuration of an illumination apparatus according to Comparative Example 7.
Figure 53:
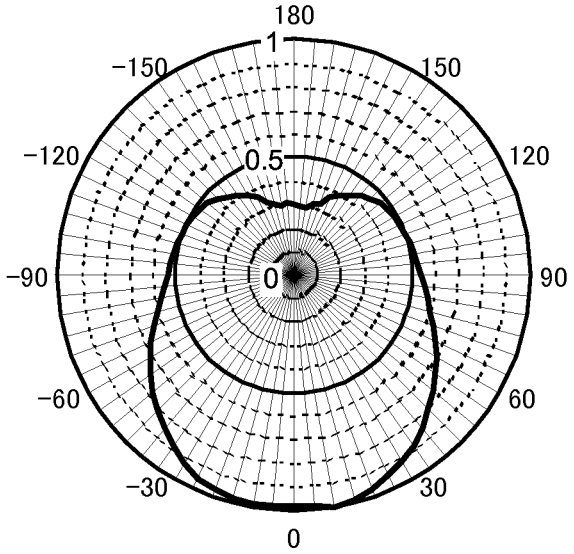
FIG. 53 is a graph illustrating the omnidirectional relative illuminance of the illumination apparatus according to Comparative Example 7.
Figure 54:
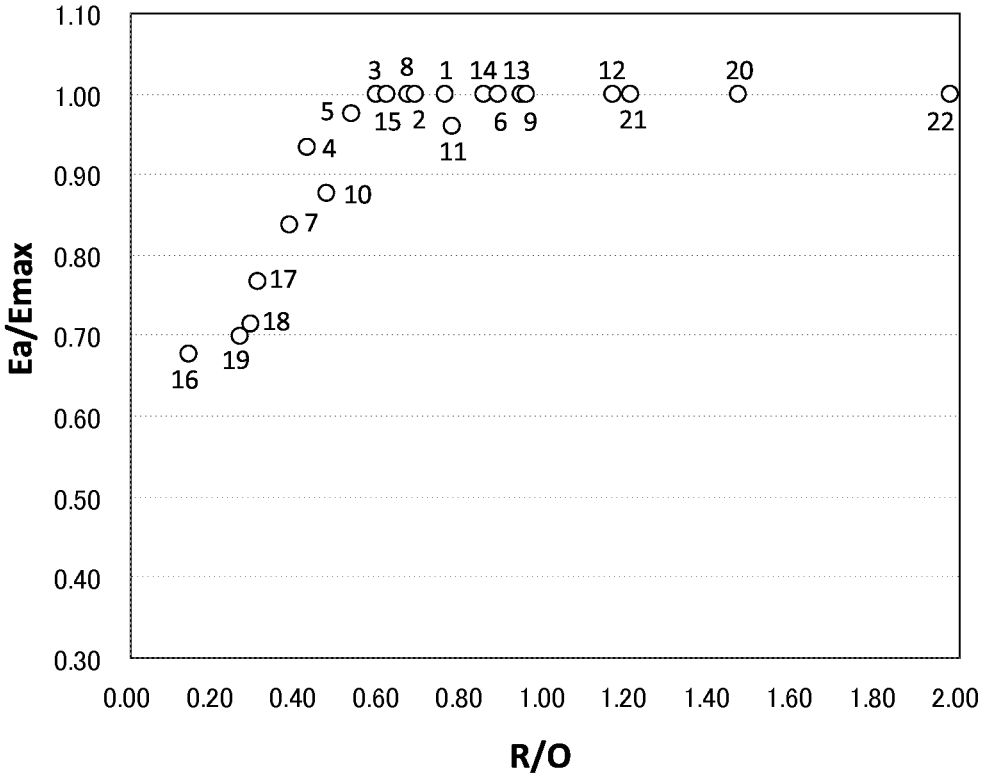
FIG. 54 is a graph illustrating the correlation of Ea/Emax versus R/O in the illumination apparatuses according to Examples 1 to 15 and Comparative Examples 1 to 7.
Figure 55:
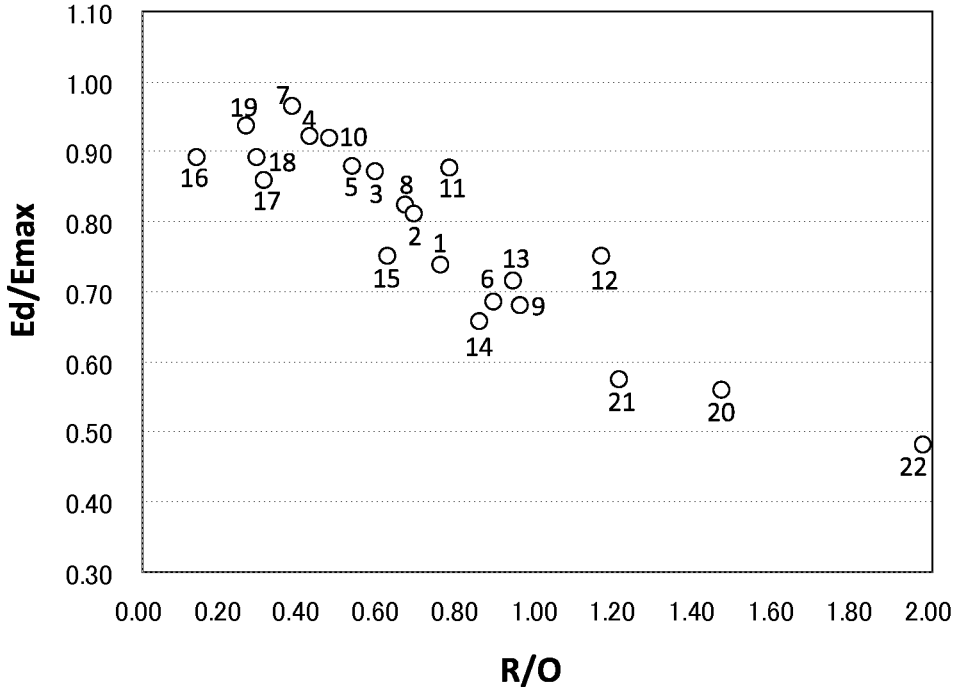
FIG. 55 is a graph illustrating the correlation of Ed/Emax versus R/O in the illumination apparatuses according to Examples 1 to 15 and Comparative Examples 1 to 7.

The light distribution characteristics of illumination apparatus 1 are illustrated in FIG. 11. The graph indicating the correlation of Ea/Emax versus R/O in illumination apparatus 1 is illustrated in FIG. 54, and the correlation of Ed/Emax versus R/O in illumination apparatus 1 in FIG. 55. It can be found from FIG. 11 that illumination apparatus 1 has wider and well-balanced light distribution characteristics.

Examples 2 to 15

The light distribution characteristics of illumination apparatuses 2 to 15 were determined in the same manner as in Example 1 except that illumination apparatus 1 is replaced by illumination apparatuses 2 to 15. The shapes of the covers of illumination apparatuses 2 to 15 are illustrated in FIGS. 12, 14, 16, 18, 20, 22, 24, 26, 28, 30, 32, 34, 36 and 38, respectively. O, R and Q in illumination apparatuses 2 to 15 are indicated in the following table 1. The light distribution characteristics of illumination apparatuses 2 to 15 are illustrated in FIGS. 13, 15, 17, 19, 21, 23, 25, 27, 29, 31, 33, 35, 37 and 39, respectively. The graph indicating the correlation of Ea/Emax versus R/O in illumination apparatuses 2 to 15 is illustrated in FIG. 54, and the graph indicating the correlation of Ed/Emax versus R/O in illumination apparatuses 2 to 15 in FIG. 55.

A cover and a light flux controlling member of illumination apparatus 15 in Example 15 are formed larger than covers and light flux controlling members of illumination apparatuses in the other Examples. Even with such illumination apparatus, light distribution characteristics closer to those of the incandescent lamp may be achieved by satisfying the above-mentioned Expression (1) with R/O.

Comparative Examples 1 to 7

The light distribution characteristics of illumination apparatuses 16 to 22 were determined in the same manner as in Example 1 except that illumination apparatus 1 is replaced by illumination apparatuses 16 to 22. The shapes of the covers of illumination apparatuses 16 to 22 are illustrated in FIGS. 40, 42, 44, 46, 48, 50 and 52, respectively. O, R and Q in illumination apparatuses 16 to 22 are illustrated in the following table 1. The light distribution characteristics of illumination apparatuses 16 to 22 are illustrated in FIGS. 41, 43, 45, 47, 49, 51 and 53, respectively. The graph indicating the correlation of Ea/Emax versus R/O in illumination apparatuses 16 to 22 is illustrated in FIG. 54, and the graph indicating the correlation of Ed/Emax versus R/O in illumination apparatuses 16 to 22 in FIG. 55.

[Table 1]

TABLE 1

| Illumination Apparatus | O (mm) | R (mm) | Q (mm) | R/O | Ea/ Emax | Ed/ Emax |
|---|---|---|---|---|---|---|
| 1 | 17.80 | 13.48 | 12.7 | 0.76 | 1.00 | 0.74 |
| 2 | 17.80 | 12.23 | 4.7 | 0.69 | 1.00 | 0.81 |
| 3 | 17.80 | 10.53 | 3.3 | 0.59 | 1.00 | 0.87 |
| 4 | 17.80 | 7.55 | 3.27 | 0.42 | 0.93 | 0.92 |
| 5 | 17.80 | 9.48 | 12.7 | 0.53 | 0.97 | 0.88 |
| 6 | 17.80 | 15.82 | 4.7 | 0.89 | 1.00 | 0.68 |

TABLE 1-continued

| Illumination Apparatus | O (mm) | R (mm) | Q (mm) | R/O | Ea/ Emax | Ed/ Emax |
|---|---|---|---|---|---|---|
| 7 | 17.80 | 6.80 | 11.3 | 0.38 | 0.84 | 0.96 |
| 8 | 17.80 | 11.89 | 11.3 | 0.67 | 1.00 | 0.82 |
| 9 | 7.80 | 7.46 | 12.7 | 0.96 | 1.00 | 0.68 |
| 10 | 12.80 | 6.06 | 3.3 | 0.47 | 0.88 | 0.92 |
| 11 | 7.80 | 6.06 | 3.3 | 0.78 | 0.96 | 0.88 |
| 12 | 7.80 | 9.08 | 3.3 | 1.16 | 1.00 | 0.75 |
| 13 | 12.80 | 12.04 | 3.3 | 0.94 | 1.00 | 0.71 |
| 14 | 13.79 | 11.78 | 4.03 | 0.85 | 1.00 | 0.66 |
| 15 | 15.64 | 9.69 | 1.86 | 0.62 | 1.00 | 0.75 |
| 16 | 17.80 | 2.50 | 11.37 | 0.14 | 0.68 | 0.89 |
| 17 | 17.80 | 5.48 | 12.7 | 0.31 | 0.77 | 0.86 |
| 18 | 17.80 | 5.14 | 4.7 | 0.29 | 0.71 | 0.89 |
| 19 | 22.80 | 6.06 | 3.3 | 0.27 | 0.70 | 0.94 |
| 20 | 7.80 | 11.43 | 12.7 | 1.47 | 1.00 | 0.56 |
| 21 | 12.80 | 15.44 | 12.7 | 1.21 | 1.00 | 0.57 |
| 22 | 7.80 | 15.42 | 12.7 | 1.98 | 1.00 | 0.48 |

As illustrated in FIGS. 11 to 39 and FIGS. 54 and 55, in illumination apparatuses 1 to 15, 80% or more of the amount of light based on the maximum value (Emax) of the amount of light in each of the omnidirectional angle ranges (Ea to Ee) is obtained at the front (0° or more and 30° or less), and 60% or more of the amount of light is obtained also at the back (more than 90° and 120° or less). It can be found from these results that use of cover 160 that satisfies the above-mentioned Expression (1) increases the amount of light forward (0° or more and 30° or less) and backward (more than 90° and 120° or less) where the amount of light becomes relatively smaller with the light distribution control by light flux controlling member 140, to enable well-balanced light distribution to be achieved.

On the other hand, as illustrated in FIGS. 40 to 47, in illumination apparatuses 16 to 19, O is too large with respect to R, so that the amount of light forward (0° or more and 30° or less) remains smaller, and thus well-balanced light distribution cannot be achieved. In addition, as illustrated in FIGS. 48 to 53 and FIG. 55, in illumination apparatuses 20 to 22, R is too large with respect to O, so that the amount of light backward (more than 90° and 120° or less) remains smaller, and thus well-balanced light distribution cannot be achieved.

In addition, it can be found from Examples 1 to 3 and 7 for example that when O is substantially fixed and the distance in the direction X from the surface of substrate 120 to P5 (maximum diameter position) is made to be larger (the position of P5 is made higher), the amount of light backward is increased.

In addition, it can be found from Examples 3 and 13 and Comparative Example 4 for example that in a case where O and Q are substantially fixed, when R is made larger, the amount of light having an angle of more than 30° and 150° or less is decreased, and when R is made smaller, the amount of light forward (0° or more and 30° or less) and backward (more than 150° and 180° or less) is decreased.

In addition, it can be found from Examples 1 and 4 and Comparative Examples 1 and 4 for example that when O is substantially fixed, R is made smaller, and the position of P5 is made higher, the amount of light forward and sideward (0° or more and 60° or less) is decreased, and the amount of light backward (more than 150° and 180° or less) is increased.

In addition, it can be found from Examples 3, 5 and 8 for example that when 0 is substantially fixed, R is made larger, and the position of P5 is made higher, the amount of light forward and sideward (0° or more and 60° or less) and the amount of light backward (more than 120° and 180° or less) are both increased.

The disclosure of Japanese Patent Application No. 2012-199464 filed on Sep. 11, 2012 including the specification, drawings and abstract are incorporated herein by reference in its entirety.

INDUSTRIAL APPLICABILITY

The illumination apparatus of the present invention may be used in place of an incandescent lamp, and is therefore widely applicable to various kinds of lighting equipment such as a chandelier and an indirect illumination apparatus.

REFERENCE SIGNS LIST

1 to 22, 100 Illumination apparatus
101 LED bulb
102 LED module
103 Body part
104 Globe
105 Light source
106 Light source substrate
107 Cover member
110 Casing
110*a* Inclining surface
110*b* Base
120 Substrate
130 Light emitting element
140, 740 Light flux controlling member
141, 741 First light flux controlling member
142 Second light flux controlling member
143 Fitting part
144 Recess
145 Reflection surface
146, 148 Flange
150 Holder
151 End surface
152 Guide projection
153 Claw part
155 Boss
156 Ventilation port
157 Locking claw
160 Cover
161 Refraction part
162 Fresnel lens part
162*a* Annular projection
1626 First inclining surface
162*c* Second inclining surface
163 Emission surface
761 Incidence surface
762 Total reflection surface
A, CA1, CA2 Central axis
C Center
LA Optical axis
P0 Point on opening of cover 160
P1 Point, which is the most distant from substrate 120, on light flux controlling member 140 in direction X
P2 Point, which is the most distant from substrate 120, on inner surface of cover 160 in direction X
P3 Point, which is the most distant from optical axis LA, of light flux controlling member 140 in direction Y
P4 Intersection of straight line through outermost edge portion of total reflection surface in direction Y and inner surface of cover 160
P5 Point, which is the most distant from optical axis LA, on inner surface of cover 160 in direction Y
P6 Point indicating outermost edge portion of total reflection surface 762 in cross-section including optical axis LA

The invention claimed is:

1. An illumination apparatus comprising:

at least one light emitting element that is disposed on a substrate and has an optical axis along a normal line to the substrate;

a light flux controlling member disposed on the substrate to control a distribution of light emitted from the light emitting element; and a cover that covers at least the light emitting element and the light flux controlling member to transmit light emitted from the light flux controlling member while diffusing the emitted light, wherein the light flux controlling member includes a first light flux controlling member that is disposed to face the light emitting element, and a second light flux controlling member that is disposed to face the first light flux controlling member, wherein the first light flux controlling member includes an incidence surface for allowing a part of the light emitted from the light emitting element to enter the incidence surface, a total reflection surface for totally reflecting light, which reached directly from the incident surface, toward the second light flux controlling member, and an emission surface for emitting a part of the light having entered the incidence surface and the light reflected at the total reflection surface toward the second light flux controlling member, wherein the second light flux controlling member has a reflection surface that faces the emission surface of the first light flux controlling member to reflect a part of light having been emitted from the first light flux controlling member and having reached the second light flux controlling member and to transmit a rest of the light, wherein the reflection surface is a rotationally symmetrical plane around the optical axis as a rotation axis and is formed such that a generatrix line of the rotationally symmetrical plane is a concave curve relative to the first light flux controlling member, an outer peripheral portion of the reflection surface is disposed at a position distant from the light emitting element in a direction X of the optical axis compared with a center portion of the reflection surface, and wherein a ratio of R to O (R/O) is more than 0.33 and less than 1.2: where O represents a distance in the direction X from a point, which is the most distant from the substrate, on the light flux controlling member to a point, which is the most distant from the substrate, on an inner surface of the cover, and R represents, in a cross-section including the optical axis, a distance in a direction Y orthogonal to the optical axis from an intersection of a straight line orthogonal to the optical axis through an outermost edge portion of the total reflection surface and the inner surface of the cover to a point, which is the most distant from the optical axis, of the light flux controlling member.

2. The illumination apparatus according to claim 1, wherein the first light flux controlling member includes Fresnel lens part having a plurality of annular projections disposed concentrically, and each of the annular projections comprises a first inclining surface that is disposed at the inside of the annular projection to function as the incidence surface, and a second inclining surface that is disposed at the outside of the annular projection to function as the total reflection surface.

3. The illumination apparatus according to claim 1, wherein

Ea/Emax is more than 0.8 and 1 or less, and Ed/Emax is more than 0.6 and 1 or less:

where, with a luminescence center of the light emitting element as a reference among the light emitted through the cover, Ea represents a sum of relative illuminance of light emitted to an area with an angle of 0° or more and 30° or less relative to the optical axis, Eb represents a sum of relative illuminance of light emitted to an area with an angle of more than 30° and 60° or less, Ec represents a sum of relative illuminance of light emitted to an area with an angle of more than 60° and 90° or less, Ed represents a sum of relative illuminance of light emitted to an area with an angle of more than 90° and 120° or less, Ee represents a sum of relative illuminance of light emitted to an area with an angle of more than 120° and 150° or less, and Emax represents a maximum value of the Ea to Ee.

* * * * *